US011788767B2

(12) United States Patent
Gorman

(10) Patent No.: US 11,788,767 B2
(45) Date of Patent: Oct. 17, 2023

(54) BOTTOM DRAIN PAN FOR PACKAGED TERMINAL AIR CONDITIONER SLEEVE

(71) Applicant: CHAMPION TRUST LLC, Fort Lauderdale, FL (US)

(72) Inventor: Christopher Allen Gorman, Fort Lauderdale, FL (US)

(73) Assignee: Champion Trust LLC, Fort Lauderdale, FL (US)

( * ) Notice: Subject to any disclaimer, the term of this patent is extended or adjusted under 35 U.S.C. 154(b) by 0 days.

(21) Appl. No.: 17/138,211

(22) Filed: Dec. 30, 2020

(65) Prior Publication Data

US 2021/0116146 A1 Apr. 22, 2021

Related U.S. Application Data

(63) Continuation-in-part of application No. 16/996,436, filed on Aug. 18, 2020, now Pat. No. 11,466,893, which is a continuation-in-part of application No. 16/665,205, filed on Oct. 28, 2019, now Pat. No. 10,746,417.

(60) Provisional application No. 62/866,788, filed on Jun. 26, 2019.

(51) Int. Cl.
*F24F 13/22* (2006.01)

(52) U.S. Cl.
CPC ..... *F24F 13/224* (2013.01); *F24F 2013/227* (2013.01); *F24F 2221/17* (2013.01)

(58) Field of Classification Search
CPC ..... F24F 13/22; F24F 13/222; F24F 13/224; F24F 2013/227; F25D 21/14; F28B 9/08; B60H 1/3233
See application file for complete search history.

(56) References Cited

U.S. PATENT DOCUMENTS 1,154,141 A * 9/1915 Tait, Jr. ..... F25D 21/14 137/247.33
2,555,968 A * 6/1951 Harbison ..... F25D 21/14 62/286
2,935,366 A * 5/1960 Cahn ..... F24F 13/22 312/213
4,248,057 A * 2/1981 Yaguchi ..... F24F 13/224 62/183

(Continued)

FOREIGN PATENT DOCUMENTS

GB 191407343 A * 7/1914 ..... F25D 21/14
JP 61231337 A * 10/1986 ..... F24F 13/22

*Primary Examiner* — Tavia Sullens

(74) *Attorney, Agent, or Firm* — The Concept Law Group, PA; Scott M. Garrett; Scott D. Smiley

(57) ABSTRACT

A packaged terminal air conditioner (PTAC) system includes a wall sleeve in which a chassis is mounted. The wall sleeve includes a bottom configured as a drain pan to collect condensate from the chilling components of the chassis. The floor of the drain pan includes a reservoir that extends downward from the floor. The floor slopes downward from the sides of the bottom to the reservoir so that water falling onto the floor flows toward and into the reservoir where it is retained until the height of the water in the reservoir exceed a rim around the drain opening. The rim further prevents treatment pellets from falling into the drain so that they can dissolve in the water captured by the reservoir until the water level of the reservoir flushes the treated water into the drain.

9 Claims, 31 Drawing Sheets

(56) References Cited

U.S. PATENT DOCUMENTS

| | | | | |
|---|---|---|---|---|
| 6,405,552 | B1 * | 6/2002 | Hubert | F24F 13/22<br>62/285 |
| 6,591,627 | B1 * | 7/2003 | Rollins | F24F 1/027<br>62/277 |
| 6,606,878 | B1 * | 8/2003 | Phillips | F24F 1/027<br>62/262 |
| 2016/0209055 | A1 * | 7/2016 | Gedcke | F24F 1/031 |
| 2017/0016635 | A1 * | 1/2017 | Shaffer | F24F 1/027 |
| 2017/0067655 | A1 * | 3/2017 | Shaffer | F24F 1/027 |
| 2017/0082317 | A1 * | 3/2017 | McKay | F24F 1/027 |
| 2018/0259220 | A1 * | 9/2018 | Shaffer | F24F 1/027 |

* cited by examiner

BOTTOM DRAIN PAN FOR PACKAGED TERMINAL AIR CONDITIONER SLEEVE

CROSS REFERENCE

This application is a continuation in part of U.S. application Ser. No. 16/996,436, filed Aug. 18, 2020, titled "Packaged Terminal Air Conditioner System and Sleeve Therefore," which is a continuation in part of, and claimed the benefit of U.S. application Ser. No. 16/665,205, filed Oct. 28, 2019, which claimed the benefit of U.S. Provisional Application No. 62/866,788, filed Jun. 26, 2019, the entireties of each of which are hereby incorporated by reference.

FIELD OF THE DISCLOSURE

The present disclosure relates generally to air conditioning systems, and more particularly to drainage maintenance of packaged terminal air conditioning (PTAC) units.

BACKGROUND OF THE DISCLOSURE

Air conditioning systems are in widespread use and are provided in two general arrangements. There are "split" systems where the evaporator unit is located indoors, and the compressor unit is located outside, with refrigerant lines connecting the two units through a wall of the structure. There are also self-contained units that package the evaporator and compressor together in one unit. Some self-contained air conditioning (A/C) systems are designed to be mounted in a window, and other similar A/C units are designed to be mounted in a through-wall opening. A common self-contained A/C unit configuration is the packaged terminal air conditioner (PTAC), which are commonly used in hotel rooms, and similar multi-occupancy structures. As with all A/C systems, the evaporator unit chills air that is drawn or blown over the evaporator coil by a fan, resulting in moisture vapor in the warm air condensing and accumulating on the coil, where it collects and runs into a pan, and drains through a drain hole into a drainage line. In some arrangements, the water is simply routed to an outside port of the PTAC unit, allowing it to drip out. In some applications the cold water is used to cool the condenser coil by routing collected condensate to the condenser portion of the unit, and a fan can splash the water onto the condenser coil.

The high moisture environment inside of a PTAC unit is highly conducive to the growth of certain molds, algae, and other microbial growth. Over time, this growth can obstruct the drain, causing a blockage, resulting in an overflow of water into the interior of the structure, resulting in water damage and potentially giving rise to other forms of mold growth in the building structure. Accordingly, property owners want to avoid the cost of repairs due to water damage caused by overflowing A/C units. This is especially problematic in self-contained A/C units because the drain pan is typically designed to hold some water to cool the coil of the compressor unit.

The problem of microbial growth in PTAC units is treated as a maintenance issue, and to prevent drain blockage from occurring, chemicals are periodically introduced into the drain pan to kill or suppress microbial growth. Chemical treatment is typically accomplished by the use of slow dissolving tablets that are placed in the drain pan. These tablets slowly dissolve in the condensate water, which creates a solution that flows into the drain, killing and inhibiting growth. However, to put these tablets into the drain pan, the PTAC unit must be taken apart by removing the chassis from the wall sleeve in order to access the interior and place the tablets in the drain pan. Although the tablets only need to be added once every several weeks or so, because of the difficulty and inconvenience involved, PTAC units often go untreated for too long, or not at all. It isn't until leakage is noticed that the drain blockage is recognized.

Therefore, a need exists to overcome the problems with the prior art as discussed above.

SUMMARY OF THE DISCLOSURE

In accordance with some embodiments of the inventive disclosure, there is provided a drain pan for a wall sleeve of a packaged terminal air conditioner that includes a floor having a perimeter, and a reservoir formed in the floor that extends downward from the floor and includes a drain opening. The floor is formed such that it slopes downward from the perimeter of the floor to the reservoir, and the drain pan is configured to be located under a chassis of the packaged terminal air conditioner in the wall sleeve.

In accordance with a further feature, the drain pan further includes a rim around the drain opening, wherein the rim is lower than a side height of the reservoir.

In accordance with a further feature, the drain pan further includes a vertical side wall formed around the perimeter of the floor.

In accordance with a further feature, a back side wall portion includes an overhang lip at top of the back side wall portion and on the outside of the back side wall portion.

In accordance with a further feature, the drain pan further includes a plurality of staking protrusions extending from the bottom surface of the floor that are configured to mate with corresponding holes in bottom portions of the wall sleeve.

In accordance with a further feature, the reservoir is positioned on the floor such that a back wall of the reservoir meets a lower wall portion of a wall having a wall opening through which the wall sleeve is mounted when the wall sleeve is sufficiently extended through the wall opening.

In accordance with a further feature, the back wall of the reservoir is flat and parallel to a back side of the floor.

In accordance with a further feature, a front of the reservoir is positioned such that a sub-base of the packaged terminal air conditioner, when installed under a front of the wall sleeve, meets the front of the reservoir.

In accordance with a further feature, the reservoir further includes a drain extension that extends downward from a bottom of the reservoir around the drain opening, and wherein the drain extension is adapted to mate with a drain plumbing line in either a push-on or a threaded connection.

In accordance with a further feature, the floor slopes downward from the perimeter to the reservoir at an angle of four to twenty degrees.

In accordance with some embodiments of the inventive disclosure, there is provided a wall sleeve for a packaged terminal air conditioner (PTAC) that includes first and second opposing vertical sides which extend from a front of the wall sleeve to a back of the wall sleeve. The wall sleeve further includes a top that extends horizontally between the first and second opposing vertical sides at a top of each of the first and second vertical sides, and which further extends from the front of the wall sleeve to the back of the wall sleeve. The wall sleeve further includes a bottom that extends between the first and second opposing vertical sides at a bottom of each of the first and second vertical sides, and which further extends from the front of the wall sleeve to the back of the wall sleeve, wherein the bottom is configured as a drain pan. Specifically, the bottom includes a floor and a reservoir formed in the floor that extends downward from the floor and includes a drain opening. The floor slopes downward from the opposing vertical sides and the front and back of the wall sleeve to the reservoir.

In accordance with a further feature, the drain pan further includes a rim around the drain opening, wherein the rim is lower than a side height of the reservoir.

In accordance with a further feature, the drain pan further includes a vertical side wall formed around a perimeter of the floor.

In accordance with a further feature, a back side wall portion includes an overhang lip at top of the back side wall portion and on the outside of the back side wall portion.

In accordance with a further feature, the drain pan further includes a plurality of staking protrusions extending from a bottom surface of the bottom that are configured to mate with corresponding holes in bottom portions of each of the opposing vertical sides.

In accordance with a further feature, the reservoir is positioned on the floor such that a back wall of the reservoir meets a lower wall portion of a wall having a wall opening through which the wall sleeve is mounted when the wall sleeve is sufficiently extended through the wall opening.

In accordance with a further feature, the back wall of the reservoir is flat and parallel to a back side of the floor.

In accordance with a further feature, a front of the reservoir is positioned such that a sub-base of the packaged terminal air conditioner, when installed under a front of the wall sleeve, meets the front of the reservoir.

In accordance with a further feature, the drain pan further includes a drain extension that extends downward from a bottom of the reservoir around the drain opening, and wherein the drain extension is adapted to mate with a drain plumbing line in either a push-on or a threaded connection.

In accordance with some embodiments of the inventive disclosure, there is provided a drain pan for a wall sleeve of a packaged terminal air conditioner that includes a floor having a perimeter, a drain opening formed in the floor, and a rim formed around the drain opening on a top side of the floor. The floor slopes downward from the perimeter to the drain opening and forms a reservoirs around the rim, and the drain pan is configured to be located under a chassis of the packaged terminal air conditioner in the wall sleeve.

Although the disclosure is illustrated and described herein as embodied in a wall sleeve for a packaged terminal air conditioner unit and a packaged terminal air conditioner unit using the wall sleeve, it is, nevertheless, not intended to be limited to the details shown because various modifications and structural changes may be made therein without departing from the spirit of the disclosure and within the scope and range of equivalents of the claims. Additionally, well-known elements of exemplary embodiments of the disclosure will not be described in detail or will be omitted so as not to obscure the relevant details of the disclosure.

Other features that are considered as characteristic for the disclosure are set forth in the appended claims. As required, detailed embodiments of the present disclosure are disclosed herein; however, it is to be understood that the disclosed embodiments are merely exemplary of the disclosure, which can be embodied in various forms. Therefore, specific structural and functional details disclosed herein are not to be interpreted as limiting, but merely as a basis for the claims and as a representative basis for teaching one of ordinary skill in the art to variously employ the present disclosure in virtually any appropriately detailed structure. Further, the terms and phrases used herein are not intended to be limiting; but rather, to provide an understandable description of the disclosure. While the specification concludes with claims defining the features of the disclosure that are regarded as novel, it is believed that the disclosure will be better understood from a consideration of the following description in conjunction with the drawing figures, in which like reference numerals are carried forward. The figures of the drawings are not drawn to scale.

Before the present disclosure is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present disclosure, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present disclosure and simplify the description, but not to indicate or imply that the devices or components must have a specific azimuth, or be constructed or operated in the specific azimuth, which thus cannot be understood as a limitation to the embodiments of the present disclosure. Furthermore, terms such as "first", "second", "third" and so on are only used for descriptive purposes, and cannot be construed as indicating or implying relative importance.

In the description of the embodiments of the present disclosure, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present disclosure according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present disclosure.

DETAILED DESCRIPTION

Figure 1:
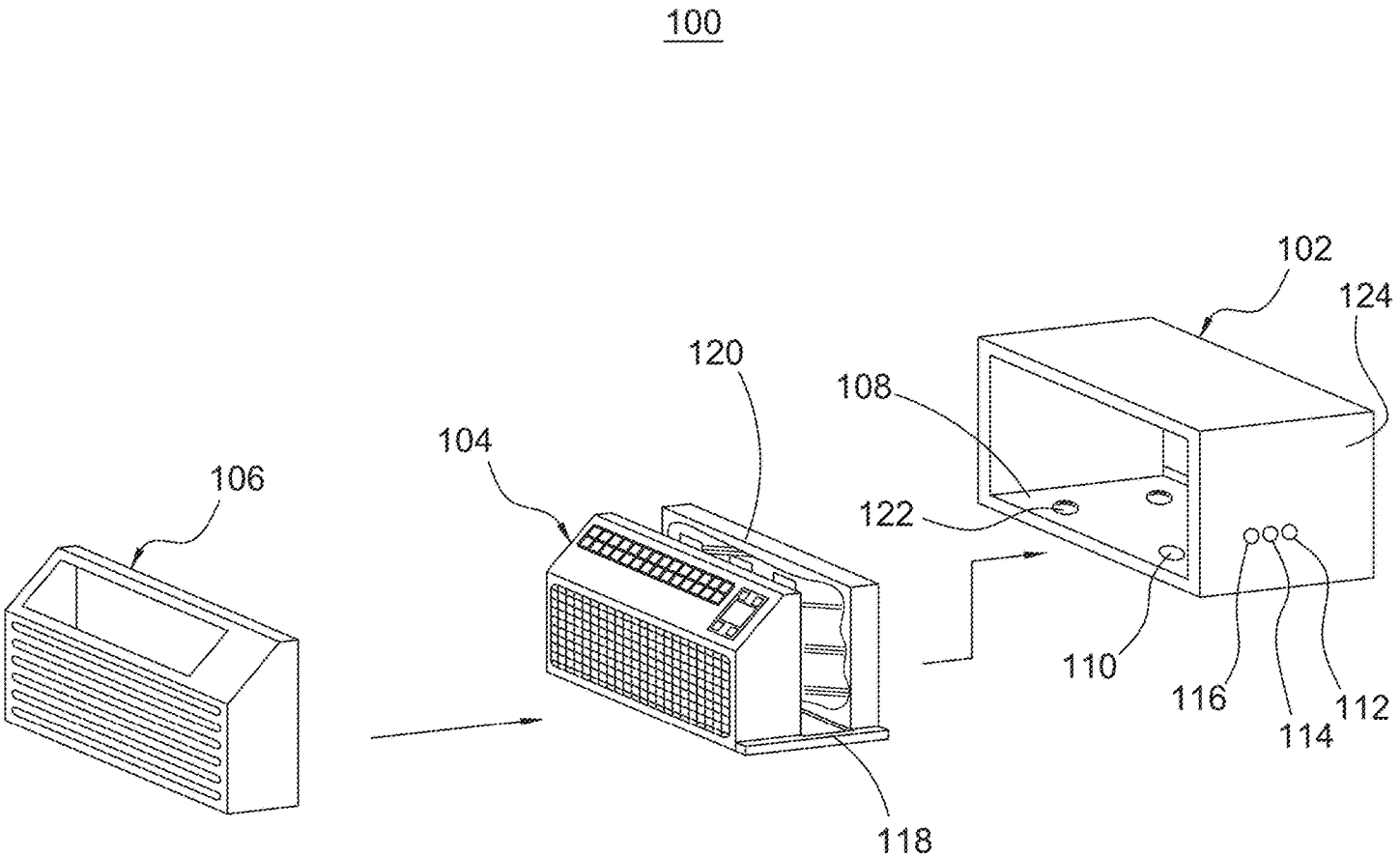
FIG. 1 is an exploded isometric view of a package terminal air conditioner (PTAC) system 100 include a wall sleeve designed in accordance with some embodiments.

While the specification concludes with claims defining the features of the disclosure that are regarded as novel, it is believed that the disclosure will be better understood from a consideration of the following description in conjunction with the drawing figures, in which like reference numerals are carried forward. It is to be understood that the disclosed embodiments are merely exemplary of the disclosure, which can be embodied in various forms.

The present disclosure provides a novel and efficient self-contained air conditioner unit that allows drainage maintenance to be performed without having to take the air conditioner unit apart or disassemble any portion of the air conditioner unit. Embodiments of the disclosure provide a self-contained air conditioner unit suitable for a through-wall or in window application where the air conditioner unit provides access-ways that allow a person to place anti-microbial treatment pellets into the internal drain pan(s) of the unit, as well providing directed access to the drain line in units that are more permanently installed.

FIG. 1 is an exploded isometric view of a package terminal air conditioner (PTAC) system 100 including a wall sleeve designed in accordance with some embodiments. A PTAC is a self-contained air conditioner system that includes the compressor unit and evaporator unit together in a chassis 104 that is mounted in a wall sleeve 102. The wall sleeve 102 is mounted in a wall, allowing access to the outside air. A PTAC is therefore different than a "split" system where the evaporator unit is located inside a building with an air handler, and where the compressor unit is located outside the building, and tubing is arranged between the two sections to carry refrigerant between them. PTAC systems are commonly used in hotel rooms, dormitories, and similar housing unit structures, and typically a PTAC system is installed through a wall, near the floor. A wall sleeve 102 is mounted in a similarly sized opening through the wall, and the small gap between the wall sleeve 102 and the wall can be weather sealed. The wall sleeve 102 can be formed of sheet metal, fiberglass, plastic, or any other suitable material, and is typically deeper, from front to back, than the wall (in which it is mounted) is thick. The wall sleeve 102 is designed to receive the chassis 104 into the wall sleeve 102 such that the chassis 104 is mounted in the wall sleeve 102. The chassis 104 includes all of the mechanical and electrical components of the air conditioner system, including the evaporator and compressor sections, as well as control circuitry to adjust the thermostat control, fan speed, and so on.

The chassis 104 has a front portion that sits inside the room and is covered by a housing 106, while the section including the condenser coil 120 is located in the back of the chassis 104 so that air from outside can be blown over the condenser coil 120 to remove heat from the compressed refrigerant in the condenser coil 120. Typically the back of the chassis 104 is covered with a louvre panel (not shown), as is known. When the PTAC is operating in a cooling mode, moisture that is in the air inside the room will condense on the evaporator coil. As the condensate collects it is routed to a drain to prevent water leaking out of the unit. It is common to use a chassis drain pan 118 to collect some of the condensate, and use the collected cold water to help cool the condenser coil 120. For example, the chassis drain pan 118 is typically arranged to collect water to a selected depth that allows the blades of the fan blowing air over the condenser coil 120 to splash water into the condenser coil 120. However, because the water then has to rise to selected drain level, some of the water stagnates in the chassis drain pan 118, allowing microbial growth to occur, which can clog the drainage path.

Typically the chassis drain pan 118 drains into a wall sleeve drain pan 108, which is essentially the bottom of the wall sleeve 102. A drain hole 110 can be formed through the bottom of the wall sleeve drain pan 108, and it is either connected to a drainage, or configured to drain out the rear of the unit (e.g. outside). Further, the wall sleeve drain pan 108 can have raised features 122 stamped or formed therein on which the bottom of the chassis 104 sits, providing space between the bottom of the chassis 104 and the wall sleeve drain pan 108.

In a conventional PTAC unit, the cover 106 and chassis 104 must be removed, at least partially, from the wall sleeve 102 in order to add treatment pellets to inhibit microbial growth in the drain pans 108, 118. Treatment pellets are formed of a chemical compound that dissolves slowly in water, and which then dissipates throughout the collected water, and into the drain, and can be formed in a variety of shapes and sizes, including, for example, spheres, belted spheres, disks, cylinders, and so on. Treatment pellets need to be added periodically since they dissolve and the flow of water dilutes the. Accordingly, it is common to establish a schedule for adding treatment pellets to the PTAC units in a facility like a hotel. However, the personnel tasked with doing so often find it difficult to take the PTAC units apart, as the chassis can be quite heavy, and care has to be taken to not spill water that may be sitting in the chassis drain pan 118. As a result, personnel sometimes neglect to perform the process of depositing treatment pellets into the PTAC units, or some PTAC units.

In order to simplify the task of putting treatment pellets into a PTAC unit, one or more openings such as apertures or openings 112, 114, 116 can be formed through a sidewall 124 of the wall sleeve 102 at a location that, when the wall sleeve 102 is installed in a wall, is exposed inside the room (e.g. a portion of the wall sleeve 102 that extends forward from the wall). However, the opening or openings are positioned such that they are not obscured by components in the chassis 104 or part of the chassis 104. On the inside of the wall sleeve 104, as will be shown in subsequent drawings, in correspondence with each opening 112, 114, 116 is a guide structure. Some of the guide structures are configured to guide a treatment pellet that is inserted into the corresponding opening to a desired location inside the PTAC unit 100. For example, aperture 112 can correspond to a guide structure that is configured to guide a treatment pellet into the chassis drain pan 118. Likewise, aperture 116 can correspond to the guide structure that is configured to guide a treatment pellet between the chassis drain pan 118 and the inside of the side wall 124 into the wall sleeve drain pan 108. A third aperture 114 can correspond to a guide structure that is configured to guide a drain snake to the drain 110 of the wall sleeve drain pan to allow servicing of the drain with the drain snake. Thus, once the PTAC unit 100 is assembled, with the chassis 104 mounted in the wall sleeve 102, maintenance personnel will no longer have to pull the chassis 104 out of the wall sleeve 102 in order to place treatment pellets into the unit. In some embodiments a cover structure can be provide on the outside of the side wall 124 that is moveable, and which covers the opening(s) 112, 114, 116 so as to prevent any undesired object or debris from getting into the unit 100.

Figure 2:
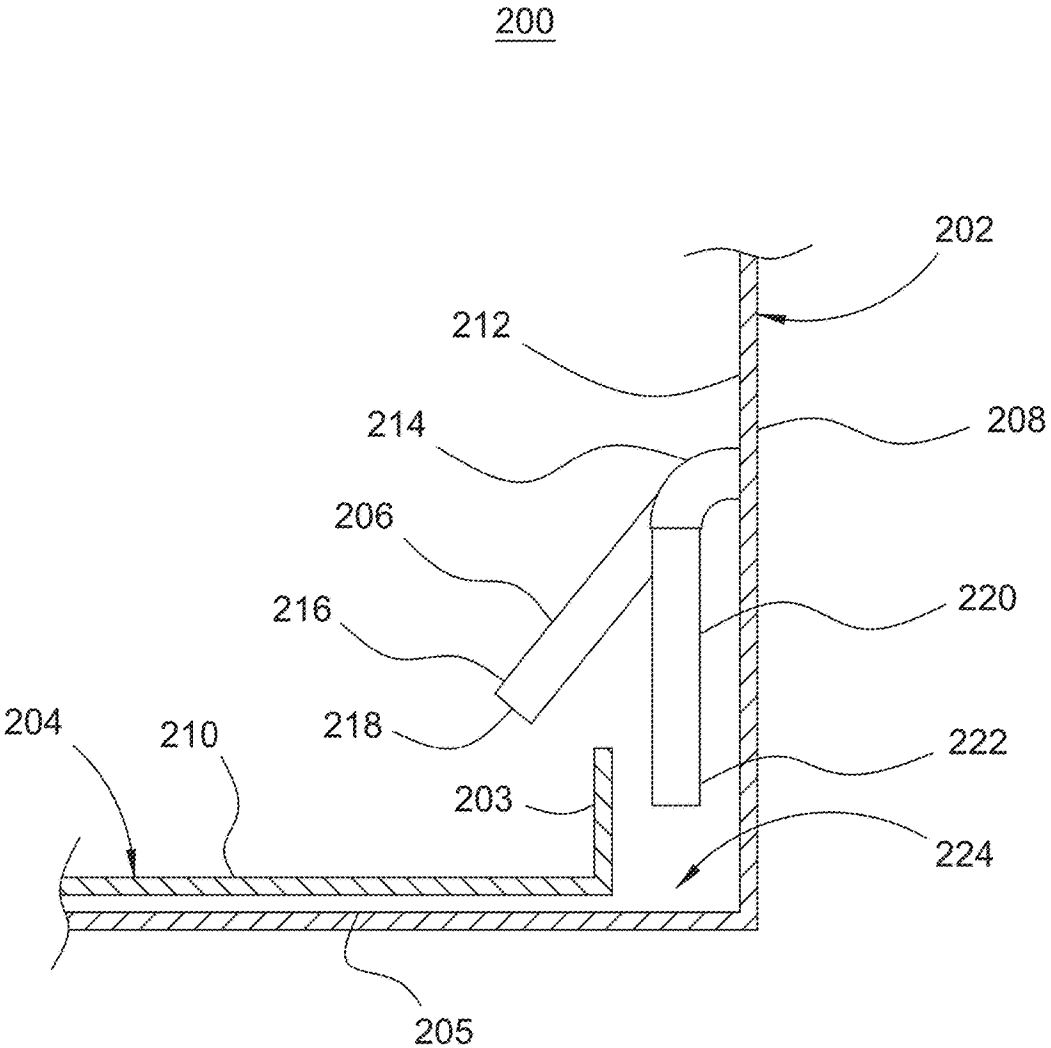
FIG. 2 a side cutaway view of a portion of an assembled PTAC system including guide structure to allow placement of treatment pellets into the PTAC, in accordance with some embodiments.

FIG. 2 a side cutaway view of a portion of an assembled PTAC system 200 including one or more guide structures to allow placement of treatment pellets into the PTAC, in accordance with some embodiments. A wall sleeve 202 includes a sidewall 208 having an inside or interior surface 212 that is opposite the exterior surface on the outside of the wall sleeve 202 (which faces the wall in which it is installed). Mounted inside the wall sleeve is a chassis, of which, shown here, is a chassis drain pan 204, having a bottom 210, in which water condensate is collected from an evaporator coil (not shown). The chassis drain pan 204 is mounted on structure of the wall sleeve 202 that elevates the bottom of the chassis drain pan above the bottom 205 of the wall sleeve 202. Specifically, the chassis is designed to be slid into the wall sleeve 202, where, once the chassis is in the proper position in the wall sleeve 202, a portion of the chassis can be screwed or bolted to corresponding portions of the wall sleeve 202. A side 203 of the chassis drain pan 204 provides a barrier to contain water collected in the chassis drain pan 204. The chassis drain pan 204 is mounted in the wall sleeve 202 such that a gap 224 is provided between the interior 212 of the sidewall 208 of the wall sleeve 202 and the side 203 of the chassis drain pan 204. In other words, there is a space between the chassis 203 and the side of the wall sleeve 202.

Attached to, or mounted on the inside 212 of the sidewall 208 of the wall sleeve 202 are several guide structures 206, 220. The guide structures 206, 220 are provided such that their upper portions 214 each correspond to a respective aperture or opening (e.g. 112, 114, 116) through the sidewall 208. A first guide structure 206 can be in the form of a tube that is bent at an angle at the top portion 214. A lower portion 216 extends outward and downward such that a lower opening 218 is positioned over the chassis drain pan 204. Thus, when a treatment pellet is inserted into the corresponding opening through the sidewall 202, the treatment pellet is guided by the first guide structure 206 such that gravity moves the treatment pellet downward through the guide structure 206 until the treatment pellet falls into the chassis drain pan 204. Thus, the PTAC unit does not need to be taken apart in order to place treatment pellets (or tablets, liquids, etc.) into the chassis drain pan 204.

A second guide structure 220, having its top portion mounted in correspondence with a second opening through the sidewall 208, is configured to guide a treatment pellet from the second opening, upon insertion of the treatment pellet through the second opening, into the wall sleeve drain pan, formed by the bottom 205 of the wall sleeve 202, through gap 224. The lower portion 222 of the second guide structure 220 is configured such that anything passing through the guide structure 220 will fall past the chassis drain pan 204 and to the bottom 205 of the wall sleeve 202. In some embodiments both the first and second guide structures 206, 220 can be made of sections of copper tubing such as that commonly used in plumbing applications. In some embodiments the guide structures 206, 220 can be made of plastic tubing or piping, such as polyvinyl chloride (PVC) piping.

Figure 3:
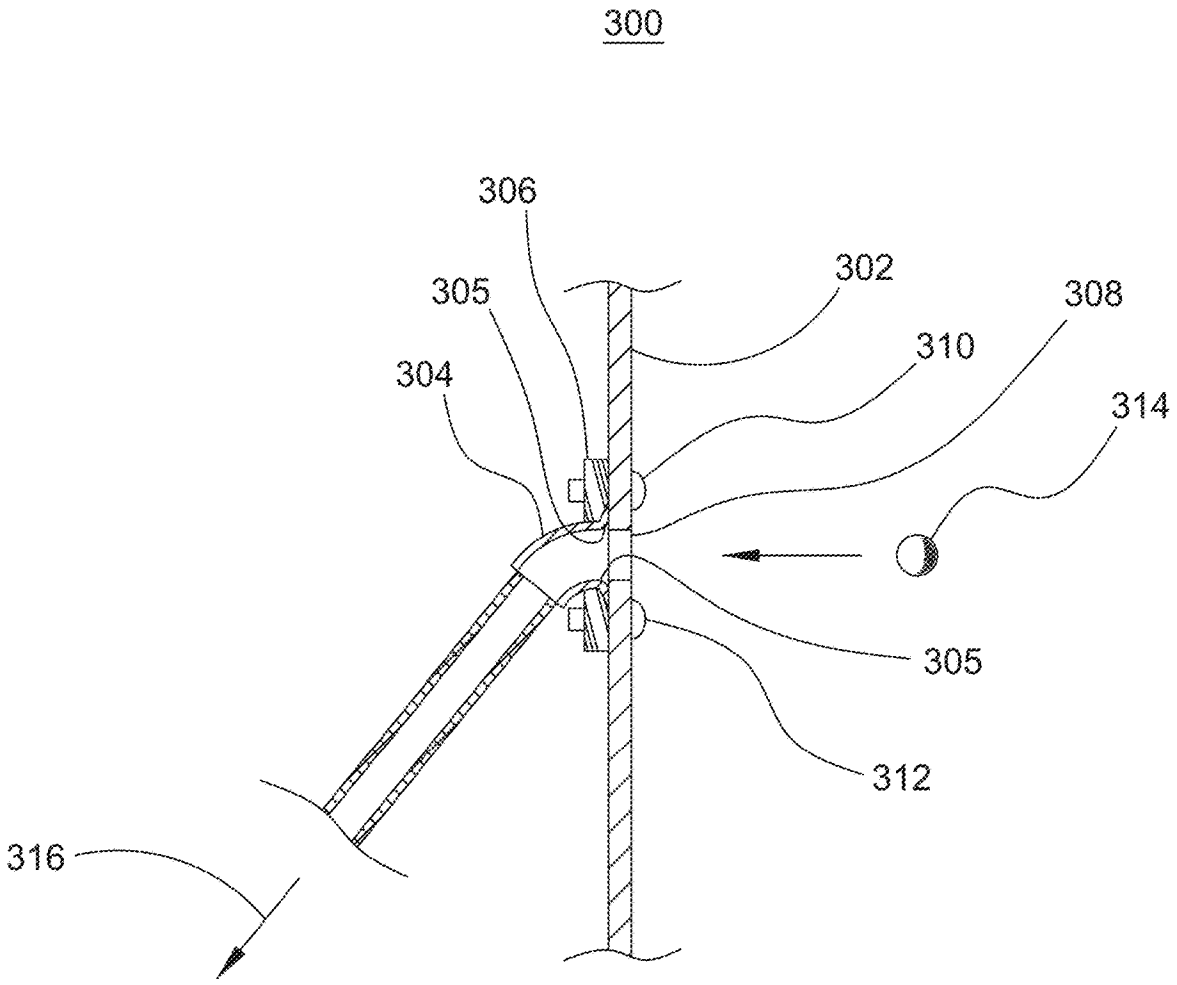
FIG. 3 is side cutaway view of a sidewall of a wall sleeve and a guide structure for guiding a treatment pellet into a chassis drain pan of the PTAC, in accordance with some embodiments.

FIG. 3 is side cutaway view 300 of a sidewall 302 of a wall sleeve and a guide structure 304 for guiding a treatment pellet 314 into a drain pan of the PTAC, in accordance with some embodiments. The guide structure 304 can be a tube component having a flared opening 305 against which a bracket 306 bears to hold the guide structure 304 in place. The flared opening 305 is positioned in correspondence with an opening or aperture 308 through the side wall 302. The bracket 306 can be held against the interior of the side wall 302 and the outside of the flared opening 305 of the guide structure 304 by rivets 310, 312 that pass through the side wall 302 and the bracket 306, thereby holding the guide structure 304 in place. Upon inserting a treatment pellet 314 into the opening 308, the treatment pellet 314 will begin rolling down the guide structure 304 in the direction of arrow 316 until it exits the guide structure 304, and into the chassis or wall sleeve drain pan. The treatment pellet can be spherically shaped and sized to fit through the opening 308 and the guide structure 304. Being spherical, the treatment pellet 314 will easily roll down the guide structure 304. As shown there, there is a short horizontal section of the guide structure 304 from the opening 308 to the downward directed portion, however, the guide structure 304 can also be configured to slope downwards from the opening 308, without any horizontal portion.

Figure 4:
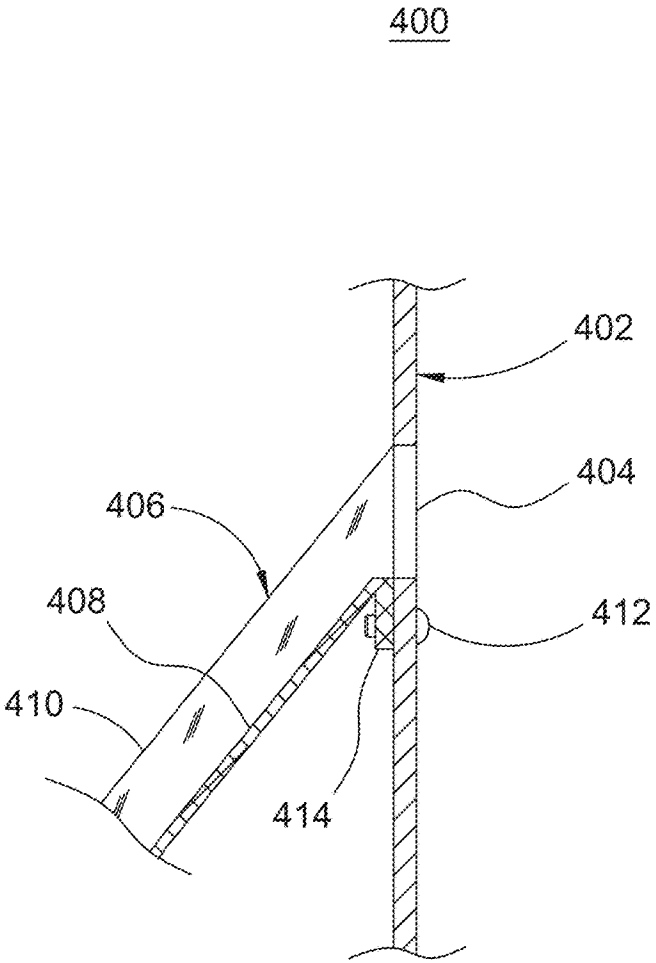
FIG. 4 is side cutaway view of a sidewall of a wall sleeve and a guide structure for guiding a treatment pellet into a portion of the PTAC, in accordance with some embodiments.

FIG. 4 is side cutaway view 400 of a sidewall 402 of a wall sleeve and a guide structure 406 for guiding a treatment pellet into a drain pan of the PTAC, in accordance with some embodiments. The guide structure 406 is positioned in correspondence with an aperture or opening 404 through the sidewall 402, and is configured as a chute having a bottom 408 and sides 410 which extend upward from the bottom 408. The guide structure 406 can be held in place by a rivets such as rivet 412 (two such rivets can be used) through a lower lip 414 which can be a portion of the bottom 408 that is bent at an angle to the bottom 408 such that the bottom 408 is at a desired downward angle. This configuration for a guide structure can be used for many shapes of treatment pellets, including disks or tablets, as well as liquids. The guide structure 406 can be made out of sheet metal that has portions bent to form the sides 410 and bottom 408.

Figure 5:
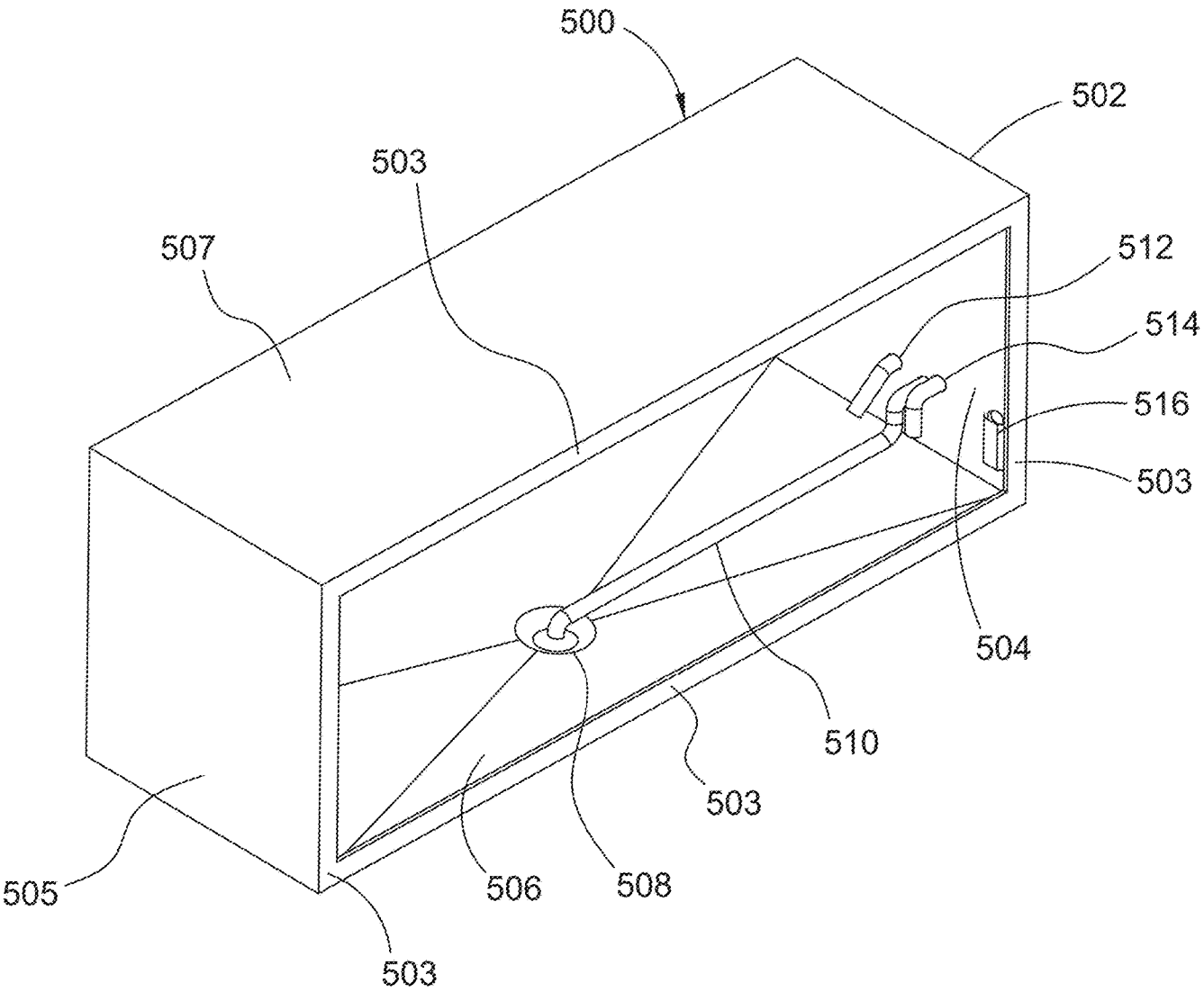
FIG. 5 is a perspective view of a wall sleeve include guide structure for treatment pellets and for a drain snake under a chassis installed that would be installed into the wall sleeve, in accordance with some embodiments.

FIG. 5 is a perspective view of a wall sleeve 500 including guide structures for treatment pellets and for a drain snake under a chassis installed that would be installed into the wall sleeve, in accordance with some embodiments. The wall sleeve 500 is shown outside of a wall, and is configured to be installed in a through-hole in a wall, as is well known. A chassis including the air conditioner components and circuitry is mounted in the wall sleeve 500 and typically secured to the wall sleeve 500 using screws or bolts at a front rim 503 of the wall sleeve 500 which is inside the room or structure in which the wall sleeve 500 is mounted. The front rim 503 surrounds the front opening through which the chassis is inserted to mount the chassis into the wall sleeve 500.

The wall sleeve 500 has first sidewall 502 that has an inside or interior surface 504. The wall sleeve 500 further includes a bottom 506, a second sidewall 505 and a top 507. The bottom 506 includes a drain opening 508, and the bottom 506 can be shaped to slope slightly downward from the sides to the drain opening 508 from the perimeter of bottom 506 to facilitate drainage. In some embodiments the edge of the drain hole 508 can be about one half inch to one and one half inches below the edges of the bottom 506, where the bottom 506 meets the sides. When the chassis is mounted into the wall sleeve 500, overflow from the chassis drain pan can drain into the bottom 506 of the wall sleeve 500 and through the drain hole 508 into a drain pipe. In some embodiments, however, water can be drained directly through the back/outside of the wall sleeve 500 to the outside environment.

The first sidewall 502 has several openings or apertures formed through the first sidewall from an exterior to the interior. There are several guide structures 510, 512, 514 which each have an end positioned in correspondence with a respective one of the several openings through the first sidewall 502. Guide structure 510 can be a tube that is configured to be against, or in sufficient proximity to the bottom 506 of the wall sleeve 500 to be under the chassis when the chassis is mounted in the wall sleeve, and traverses across the wall sleeve 500 from the interior 504 of the first sidewall 502 at an opening to the bottom 506, and across the bottom 506 to the drain hole 508. The end of the guide structure 510 at the drain hole 508 is turned downward to direct anything passing through guide structure 510 into the drain through drain hole 508. For example, a drain snake can be passed from the outside of the PTAC unit through the opening corresponding to the guide structure 510, and through the guide structure 510 into the drain pipe through the drain hole 508 in order to clean out the drain pipe and dislodge any material that may be blocking the drain. Further, drain maintenance liquids (e.g. "drain de-clogger") can be poured through guide structure 510 directly into the drainage line. These maintenance operations can be performed without having to disassemble the PTAC unit.

Likewise another guide structure 512 can be configured to have a free end disposed over the chassis drain pan when the chassis is mounted in the wall sleeve 500, and is mounted on the interior 504 of the first side wall 502 of the wall sleeve at an aperture through the sidewall 502. Thus, guide structure 512 allows a person to deposit a treatment pellet into the chassis drain pan by inserting the treatment pellet into the aperture through the sidewall 502 corresponding to the guide structure 512, whereupon gravity will draw the treatment pellet down and through the guide structure 512 where the treatment pellet will fall into the chassis drain pan. Another guide structure 514 is configured to direct treatment pellets from yet another aperture through the sidewall 502 into the wall sleeve bottom 506, which acts as a wall sleeve drain pan. Guide structure 514 is similar to guide structure 220 of FIG. 2, and directs treatment pellets though a gap between the chassis drain pan and the interior 504 of the first sidewall 502, or through a tube or passageway formed in the chassis drain pan. An alternative guide structure 516 can be formed over the interior 504 of the first sidewall 502 that creates a passage between the interior surface 504 and the guide structure 516 to guide treatment pellets into the bottom 506 of the wall sleeve 500. In particular disk-shaped tablets can be inserted into the opening corresponding toe guide structure 516 and even stacked inside guide structure 516, allowing the bottom tablet to dissolve slowly, so that if maintenance personnel see room to add another tablet they can, and won't need to do so before there is room to add another tablet.

Guide structures 510, 512, 514, 516 are mounted on the interior 504 of the first side wall in a position so that the chassis of the PTAC unit can be moved in and out of the wall sleeve 500 without the guide structures 510, 512, 514, 516 snagging or interfering with the movement of the chassis in or out of the wall sleeve 500. In particular, guide structure 512, which extends over the chassis drain pan when the chassis in mounted in the wall sleeve 500, does not extend far enough into the interior space of the wall sleeve that it will be in the way of components on the chassis when the chassis is moved into or out of the wall sleeve 500. Accordingly, components on the chassis have to be configured such that there is clearance for the guide structure 512, and that the chassis drain pan will be under the lower end of guide structure 512.

Figure 6:
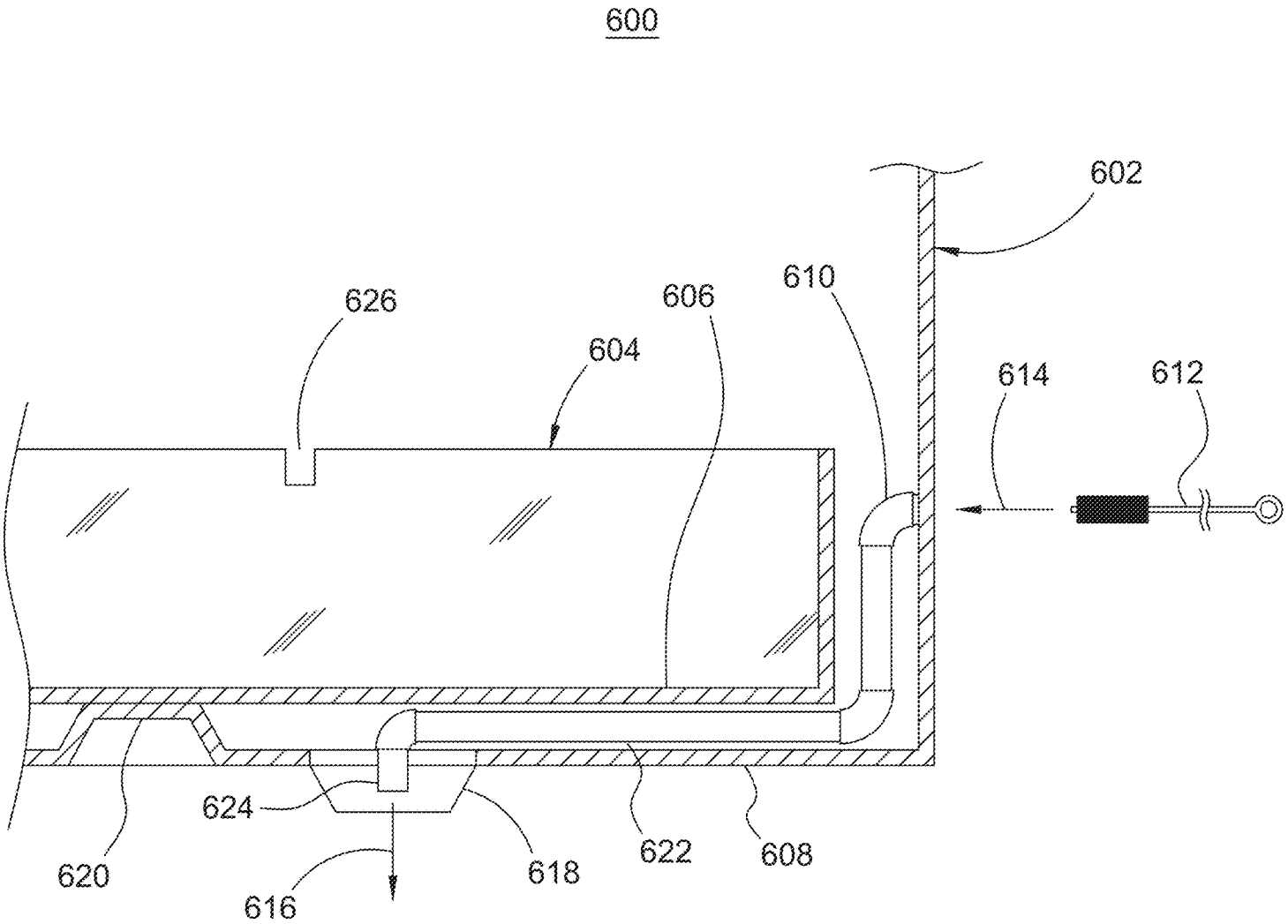
FIG. 6 is a side cutaway view of a PTAC showing a drain snake guide structure, in accordance with some embodiments.

FIG. 6 is a side cutaway view of a PTAC unit 600 showing a drain snake guide structure, in accordance with some embodiments. A wall sleeve 602 holds a chassis that includes a chassis drain pan 604 having a bottom 606. The chassis drain pan 604 holds a selected level of water that condenses on the evaporator coil and drains down into the chassis drain pan 604. The collected water is used to cool the condenser coil by the condenser fan splashing the collected water and blowing it into the condenser coil, as is well known. Excess water drains into the bottom 608 of the wall sleeve 602, under the chassis drain pan 604 through, for example, notch 626 in the side of the chassis drain pan 604. The chassis is mounted in the wall sleeve 602 such that there is a gap or space between the bottom 606 of the chassis drain pan 604 and the bottom 608 of the wall sleeve 602. For example, several upward bosses 620 can be formed into the bottom 608 of the wall sleeve 602 that bear against the bottom 608 of the chassis drain pan 604 or other parts of the chassis. The bottom 608 is shown flat here, but can be configured to slope from the sides to the drain hole 618 to facilitate drainage. A guide structure 622 is provided in this space, and has a first end 610 positioned in correspondence with an opening through the sidewall of the wall sleeve 602. The guide structure 622 can be a tube or narrow pipe assembly and has a second end 624 positioned over a drain hole 618. A drain snake 612 can be inserted into the guide structure 622 in the direction of arrow 614 through the opening, and along the guide structure 622 until it comes out the second end 624 in the direction of arrow 616 and into the drain line. Thus, the guide structure 622 allows maintenance of the drain line without having to remove the chassis from the wall sleeve 602.

Figure 7:
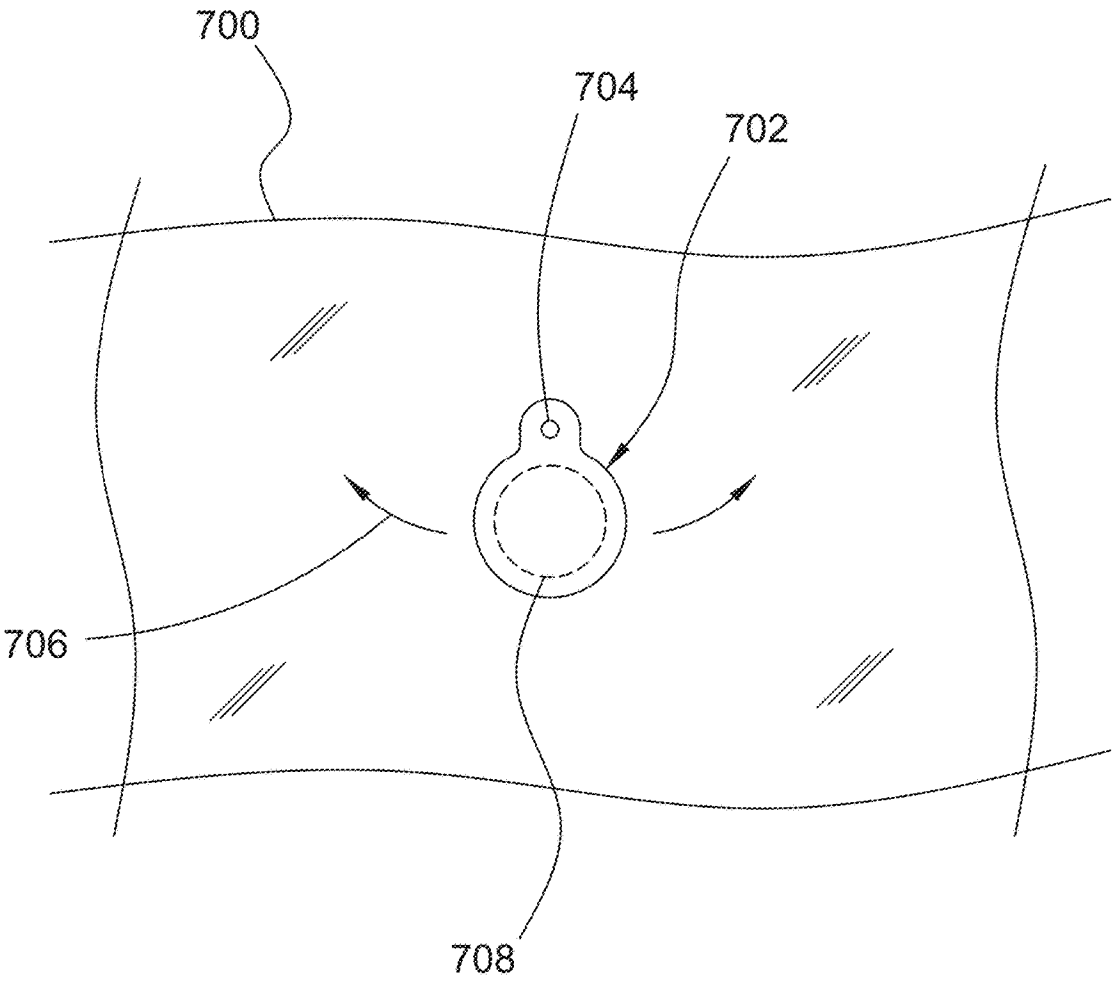
FIG. 7 shows a side elevational view of a sidewall of a wall sleeve, at the outside, on which a cover is mounted for covering an aperture formed through the sidewall, in accordance with some embodiments.

FIG. 7 shows a side elevational view of a sidewall 700 of a wall sleeve, at the outside, on which a cover 702 is mounted for covering an aperture 708 formed through the sidewall, in accordance with some embodiments. In this view the cover 702 is positioned over (covering) the aperture 708. The aperture 708 is an opening through the sidewall 700 and a guide structure is positioned on the other side of the sidewall 700 in correspondence with the aperture 708. The aperture 708 is sized such that a treatment pellet or tablet can pass through the aperture. In some embodiments the aperture 708 can be sized to exclude standard tablet/disc shaped treatment pellets commonly available on the market but sized large enough to accept a spherical treatment pellet that will roll down the corresponding guide structure.

The cover 702 can be a flat member that is attached to the sidewall 700 at a pivot point 704 that allows the cover 702 to move about the pivot point 704 as indicated by arrows 706. The pivot point is located directly over the aperture 708 and the cover 702 hangs on the pivot point 704 such that it naturally covers the aperture 708 unless moved to the side (i.e. in the direction of arrow 706). The cover 702 prevents debris and other objects from entering the PTAC unit. When a treatment pellet is to be provided into the PTAC unit, the cover 702 can be moved by pivoting it around the pivot point 704 to reveal the aperture 708, thereby allowing a treatment pellet to be inserted into the opening 708. The pivot point 704 can be a rivet or similar feature that attaches to the sidewall 700. Other forms of covers can be used equivalently, including, for example, a flap that hangs over the aperture 708 or several apertures, having a bottom that lifts up and away from the sidewall.

Figure 8:
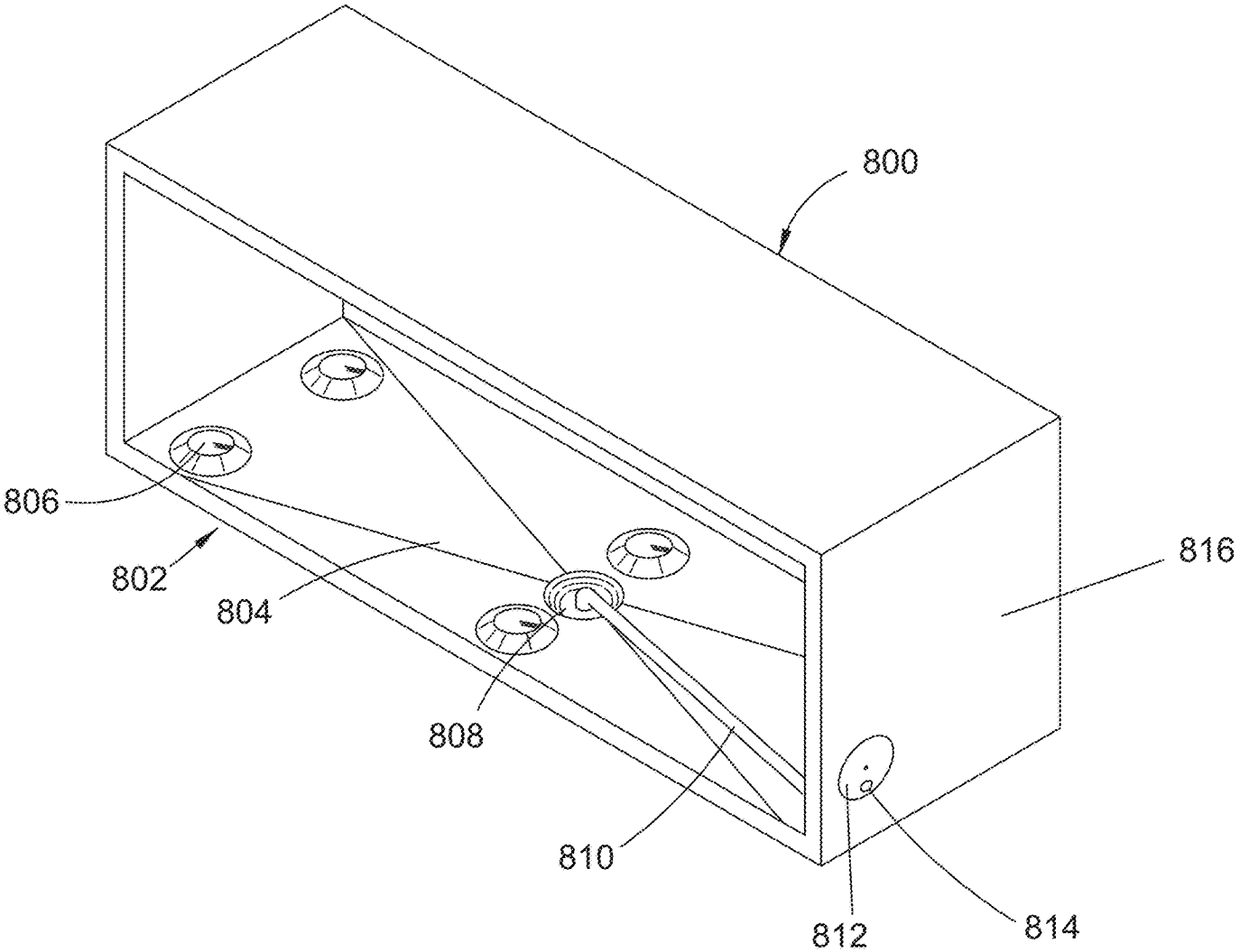
FIG. 8 shows a perspective view of a wall sleeve assembly showing an outside of the side of the wall sleeve where a rotating cover is mounted, in accordance with some embodiments.

FIG. 8 shows a perspective view of a wall sleeve 800 for a PTAC unit that is designed in accordance with some embodiments. In particular, the wall sleeve 800 provides drainage and maintenance features not found on existing PTAC units. The front 802 of the wall sleeve 800 is open, which allows for a PTAC chassis to be inserted into the wall sleeve 800. The wall sleeve 800 is itself mounted through a wall so that heat can be removed from an interior space to the exterior space by otherwise conventional air conditioning techniques. The wall sleeve 800 has a bottom 804 that is sloped toward a drain 808. That is, where the bottom 804 meets the drain is the lowest point of the bottom 804, with the highest part of the bottom 804 being where the bottom 804 meet the sides, such as side 816. The drain hole 808 can be on the order of one half inch to one and one half inches lower than the edges of the bottom 804 where the bottom 804 meets the vertical sides of the wall sleeve 800. The bottom 804 can include several standoffs 806 which are raised portions that support the chassis and create space between the bottom of the chassis and the rest of the bottom 804. A drain access tube 810 is a guide structure that can be used to guide a drain cleaning tool into the drain 808. The drain access tube 810 therefore has one end over the drain 808 and another end on the side 816, which can be concealed by a rotating cover 812. The rotating cover 812 is a circular member that is mounted on the side 816 so as to rotate about its center point. The rotating cover 812 has an opening 814 formed through the rotating cover 812, and by rotating the rotating cover about its center mounting point allows a user to align the opening 814 with the opening of any of two or more different guide structures, the drain access tube 810 being one of the guide structures. The opening 814 has a center that is a distance away from the center of the rotating cover 812, and as a result, when the rotating cover 812 is rotated, the opening follows a circular path. The openings of the various guide structures are positioned in correspondence with this circular path. In the present example there are three total guide structures. The other two guide structures allow a user to deposit treatment pellets into the chassis pan or to the bottom 804 of the wall sleeve 800 which acts as a wall sleeve drain pan.

Figure 9:
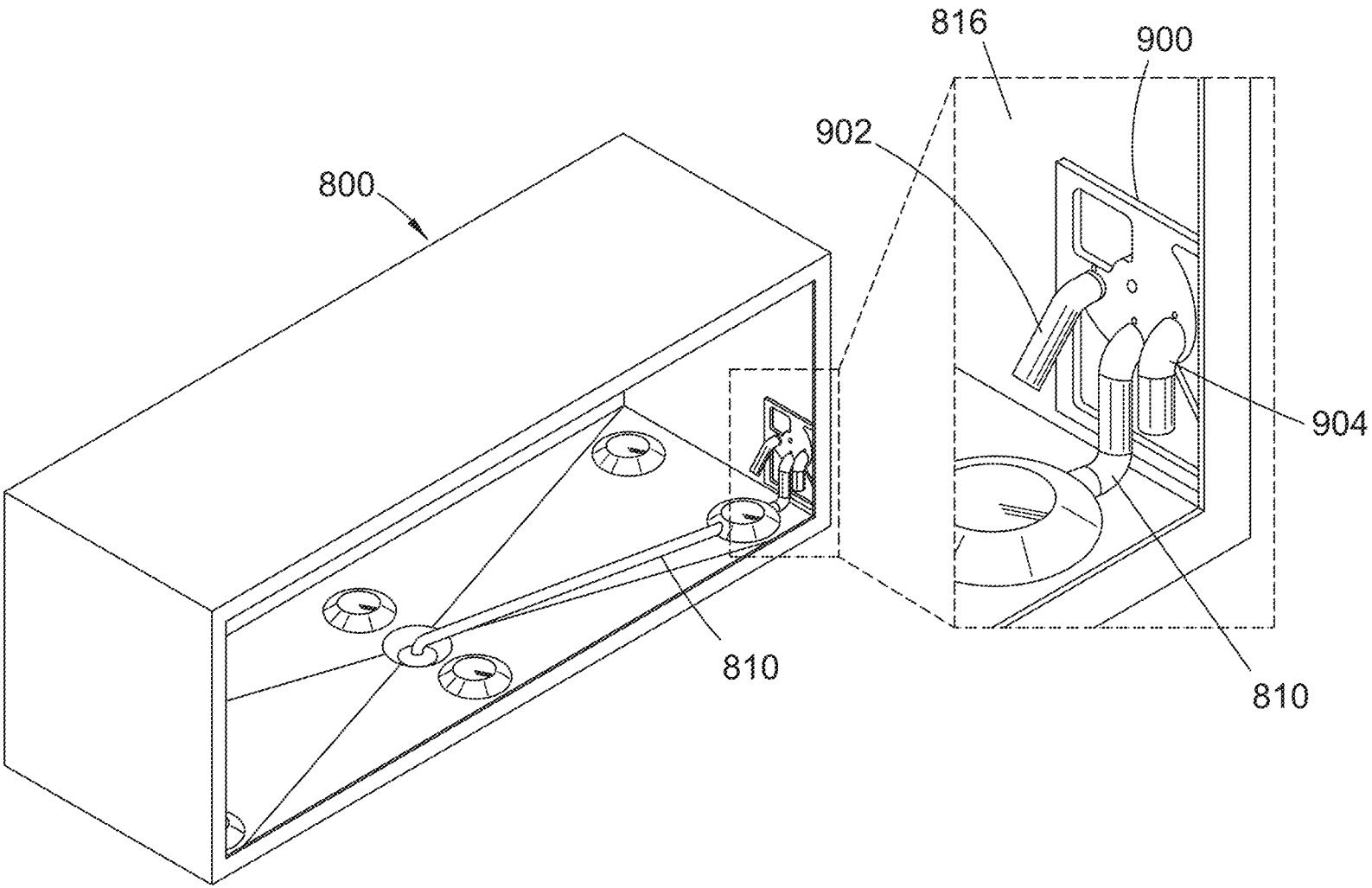
FIG. 9 shows a perspective view of a wall sleeve assembly showing an inside of the side of the wall sleeve where a mounting plate is mounted, and including a detail showing the various guide structures mounted in the wall sleeve, in accordance with some embodiments.

FIG. 9 shows a perspective view of the wall sleeve 802, showing the inside of side 816, and the guide structures attached to the side of the wall sleeve, in accordance with some embodiments. A mounting plate 900 is used to capture the openings of guide structures 902, 904, and drain access tube 810 in alignment with corresponding holes through the side 816 of the wall sleeve. Guide structure 902 can be configured to guide a treatment pellet into the chassis pan from an opening on the side 816. Likewise, guide structure 904 can be configured to guide a treatment pellet into the bottom 804 of the wall sleeve 800. The openings of guide structures 810, 902, 904 are arranged on circular path that is traversed by the opening 814 of the rotating cover 812 on the outside of side 816.

Figure 10:
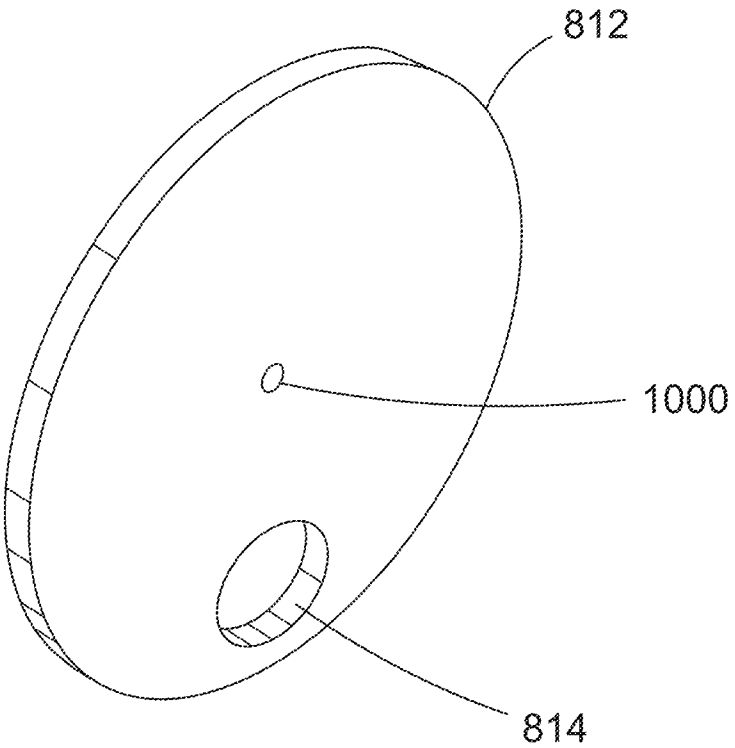
FIG. 10 shows a perspective view of a rotating cover, in accordance with some embodiments.
Figure 11:
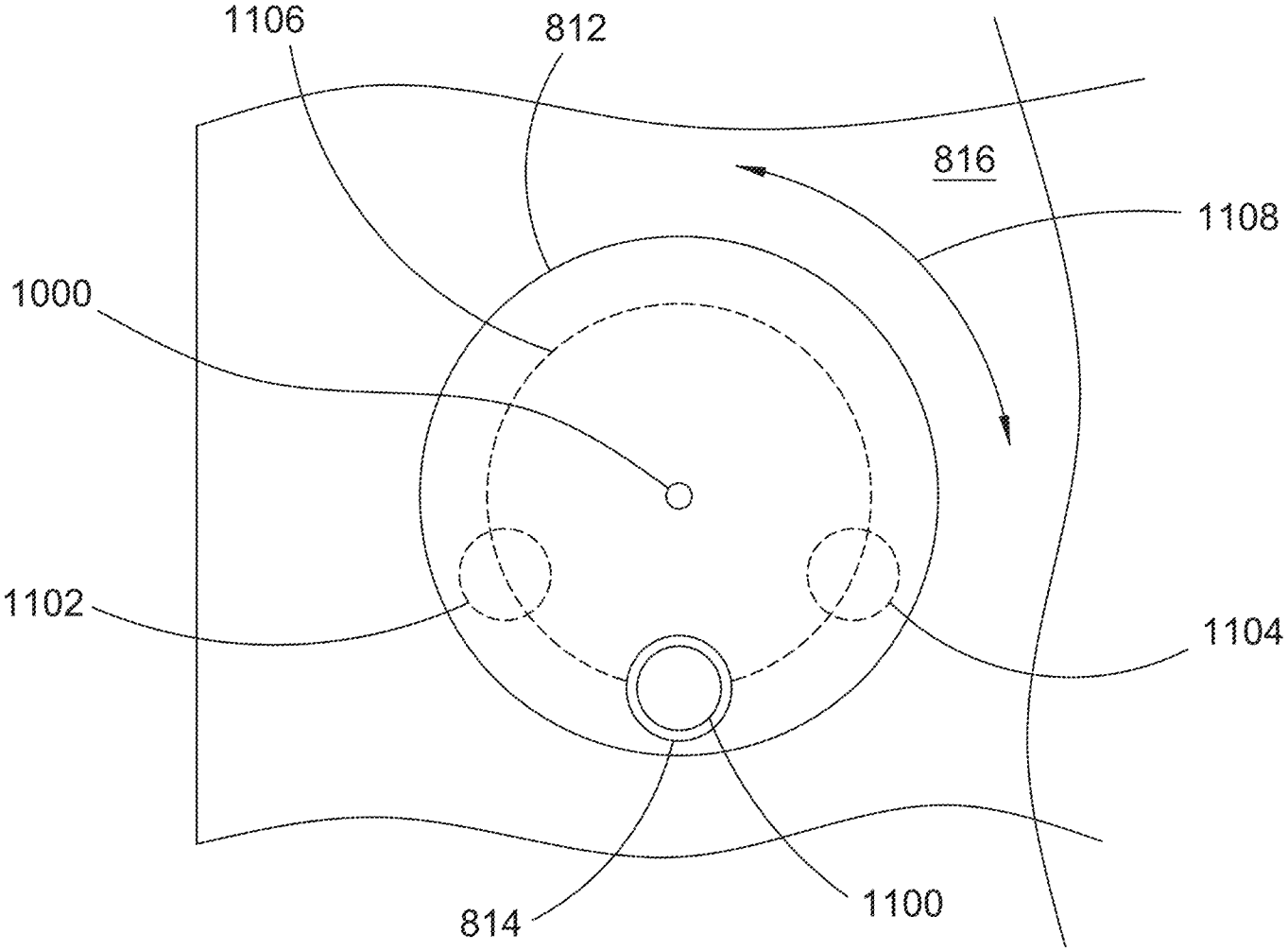
FIG. 11 shows an elevational view of a rotating cover as mounted on the side of a wall sleeve, in accordance with some embodiments.

FIG. 10 shows a rotating cover 812 for use on the outside side of a wall sleeve 800, in accordance with some embodiments. The rotating cover 812 can be a circular disk having a mounting hole 1000 at the center of the disk about which the rotating cover 812 will rotate once mounted on the wall sleeve 800. The rotating cover 812 has an opening 814 through the rotating cover 812 that allows access to the opening of any of the various guide structures by rotating the rotating cover 812 until the opening 814 aligns with the opening of the desired guide structure. As the rotating cover 812 rotates about the mounting hole 1000, the opening 814 follows a circular path. FIG. 11 shows the rotating cover 812 mounted on the side 816 of the PTAC wall sleeve. The rotating cover 812 is mounted on a fastener that passes through the mounting hole 1000 and the side 816 of the wall sleeve. Accordingly, the rotating cover 812 can rotate about the mounting hole 1000 as indicated by arc 1108. Further, opening 814 follows a circular path 1106 as the rotting cover 812 is rotated. The rotation is in a plane that is parallel to the plane of the side 816 of the wall sleeve. Also located in the circular path 1106 are the openings of several guide structures 1100, 1102, 1104. Each of the openings 1100, 1102, 1104 connects to a different, respective guide structure. For example, opening 1100 can connect to the drain access tube 810, opening 1102 can connect to guide structure 904, and opening 1104 can connect to guide structure 902. The openings 1100, 1102, 1104 can be the open end of the guide structures, which necessarily have to pass through similar openings in the side 816 of the wall sleeve. Alternatively, the openings 1100, 1102, 1104 can be openings in the side 816 which lead to the open end of the guide structures.

Figure 12:
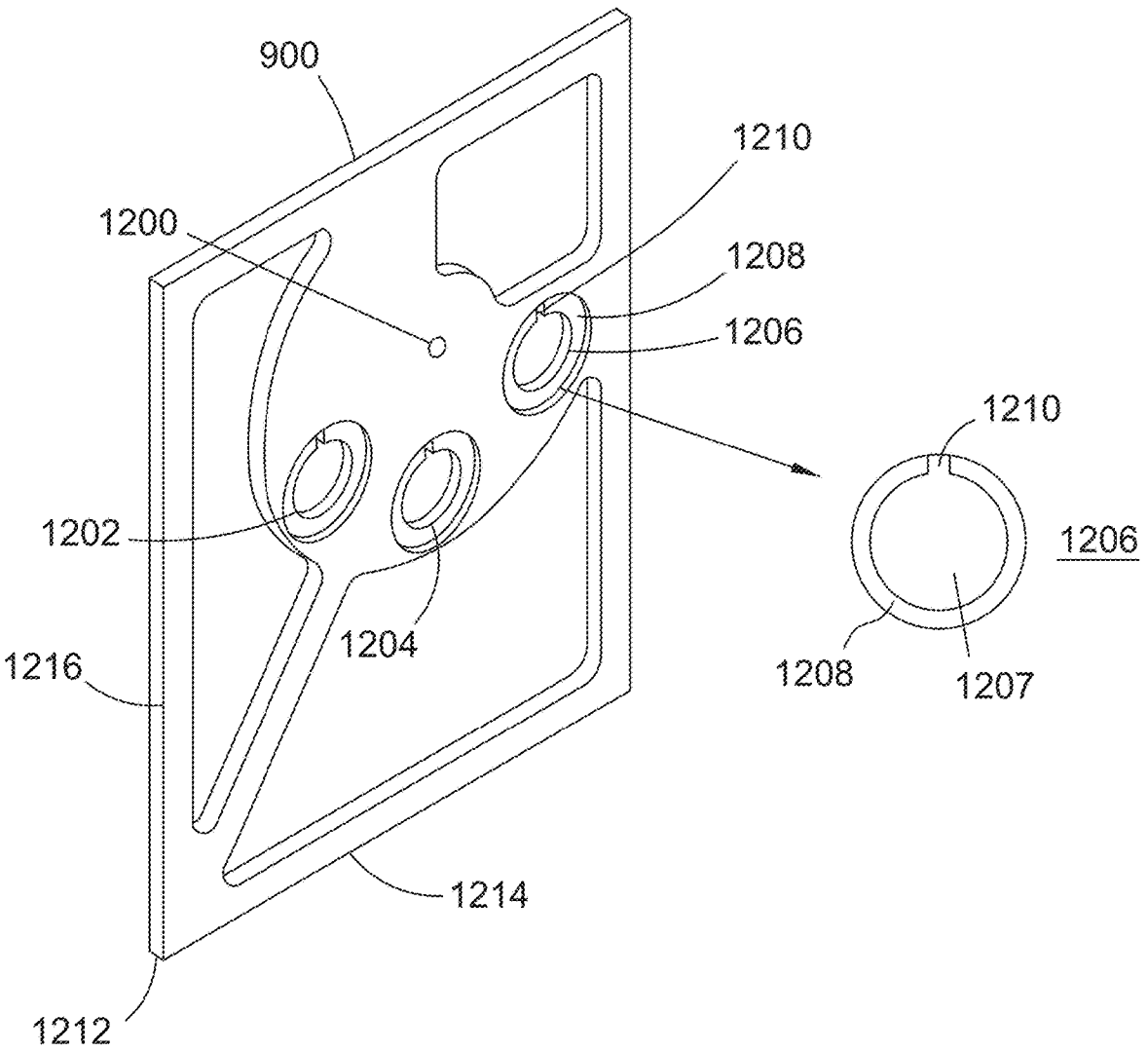
FIG. 12 shows a perspective view of a mounting plate for use in mounting guide structures in a wall sleeve for a PTAC, in accordance with some embodiments.

FIG. 12 shows a mounting plate 900 for use in securing guide structures to the side a wall sleeve, in accordance with some embodiments. The mounting plate 900 aligns and captures the guide structures against the inside of the wall sleeve in correspondence with their respective openings through the side of the wall sleeve (e.g. 1100, 1102, 1104). The mounting plate 900 includes a through hole 1200. A pin or similar retaining structure (not shown) can pass through the through hole 1200 and the mounting hole 1000 of the rotating cover 812 and a corresponding hole in the side of the wall sleeve. The mounting plate 900 also include several shouldered holes 1202, 1204, 1206, which are arranged on a circle centered at the through hole 1200, which corresponds to circular path 1106 on which the openings 1100, 1102, 1104 are arranged. Further, each of the shouldered holes 1202, 1204, 1206 has an opening through the mounting plate 900 that is surrounded by a shoulder, in which an alignment notch is cut that is contiguous with the opening. This is shown in the detail of shouldered hole 1206 in which the opening 1207 is shown, surrounded by a shoulder 1208, in which an alignment notch 1210 is cut. The shoulder 1208 is a circular section of the mounting plate that is reduced in thickness to capture a portion of the guide structure between the shoulder 1208 and the inside of the wall sleeve. The mounting plate 900 can also include alignment features to align the mounting plate 900 to the inside of the wall sleeve. For example, the mounting plate 900 can include a corner 1212 formed by sides 1214, 1216. The corner 1212 and sides 1214, 1216 can align to a corresponding corner and sides on the inside of the wall sleeve, eliminating the need to measure the wall sleeve when installing the mounting plate 900 and guide structures.

Figure 14:
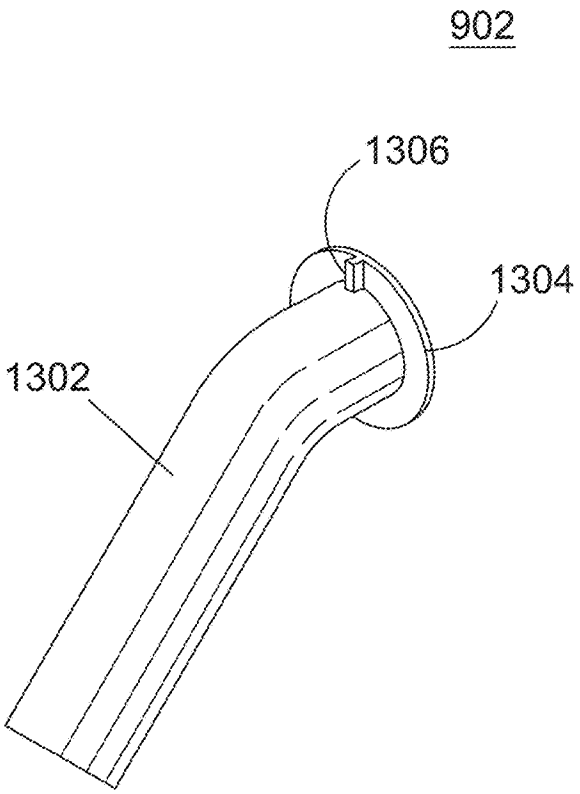
FIG. 14 shows a rear perspective view of a guide structure, in accordance with some embodiments.
Figure 13:
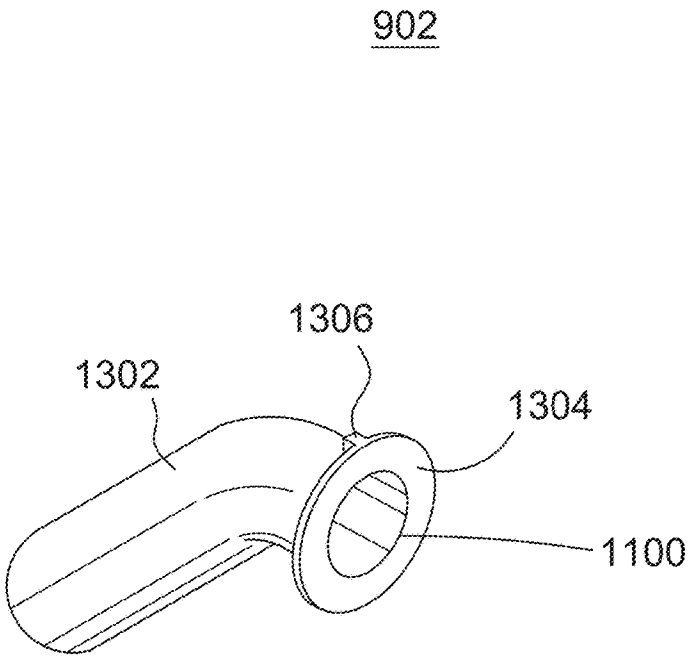
FIG. 13 shows a front perspective view of a guide structure, in accordance with some embodiments.
Figure 15:
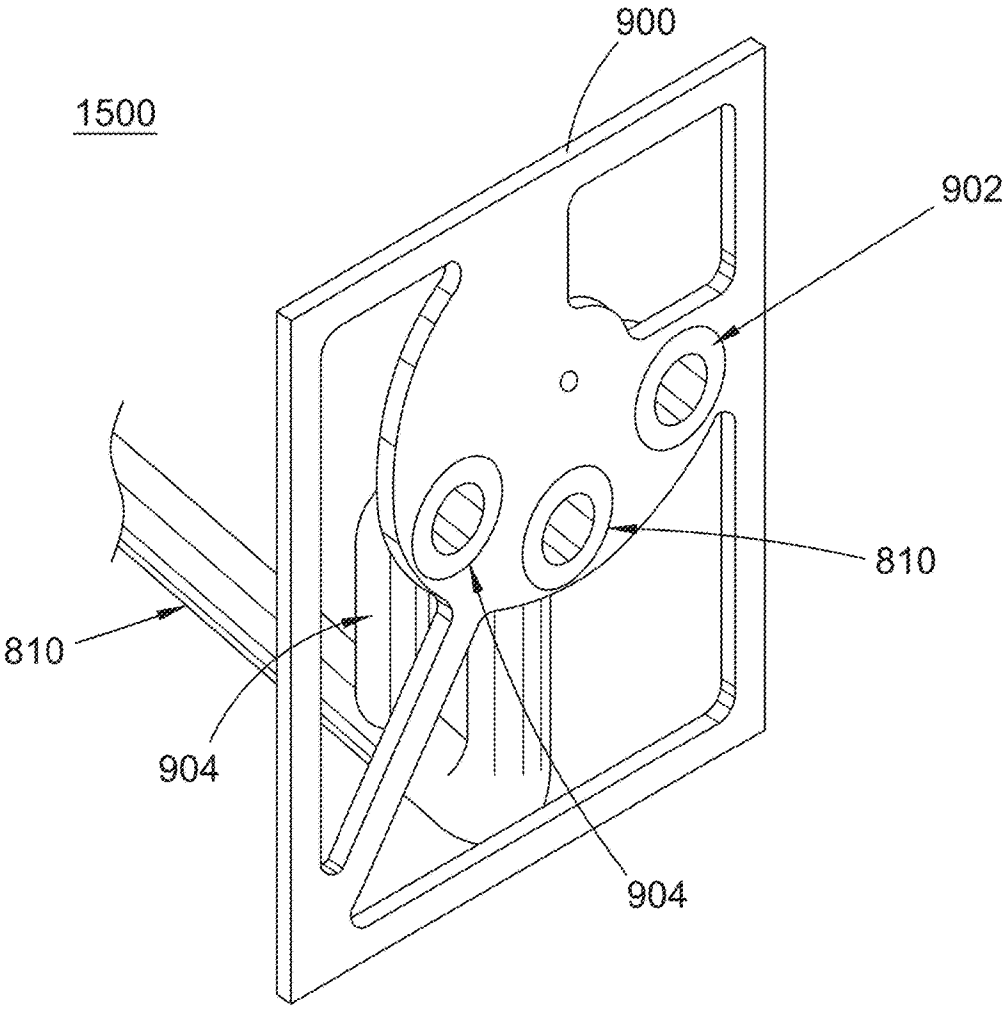
FIG. 15 shows a perspective view of a mounting plate with guide structures assembled into the mounting plate prior to mounting the mounting plate on a side, in accordance with some embodiments.

FIGS. 13 and 14 show front and rear perspective views, respectively, of a portion of a guide structure 902 to be mounted in a mounting plate such as mounting plate 900. The guide structure 902 is configured to guide a treatment pellet into a portion of a PTAC unit, or allow access to the drain for cleaning. The guide structure 902 can include a generally tubular body 1302 or equivalent structure formed to guide a treatment pellet or cleaning brush to a desired location in the PTAC from outside of the PTAC. The guide structure 902 has an end that forms an opening 1100 surrounded by a flange 1304. The flange 1304 is sized to correspond with the recess of the shoulder 1208 of the shouldered holes 1202, 1204, 1206 of the mounting plate 900. That is, the flange 1304 has a thickness that is as thick as the depth of the shoulder recess of the shoulder 1208. Further, the flange 1304 is generally flat across the face of the flange as it is captured between the shoulder 1208 and the inside surface of the side of the wall sleeve. An alignment tab 1306 can be provided to fit into the alignment notch 1210 to align the guide structure in a proper orientation. FIG. 15 shows an assembly 1500 of a mounting plate 900 with several guide structures 810, 902, 904 placed into the mounting plate 900 and ready to be mounted on the side of the wall sleeve. Each guide structure 810, 902, 904 has a flange portion that fits within a shoulder recess of a corresponding opening through the mounting plate 900. When the mounting plate 900 is mounted in place against the side (the inside) of the wall sleeve, the guide structures 810, 902, 904 will be captured in place. The rotating cover (e.g. 812) will be mounted on the outside of the side of the wall sleeve and will allow only one of the guide structures 810, 902, 904 to be accessible at a time, or to cover all of them so as to keep out debris or other matter.

Figure 16:
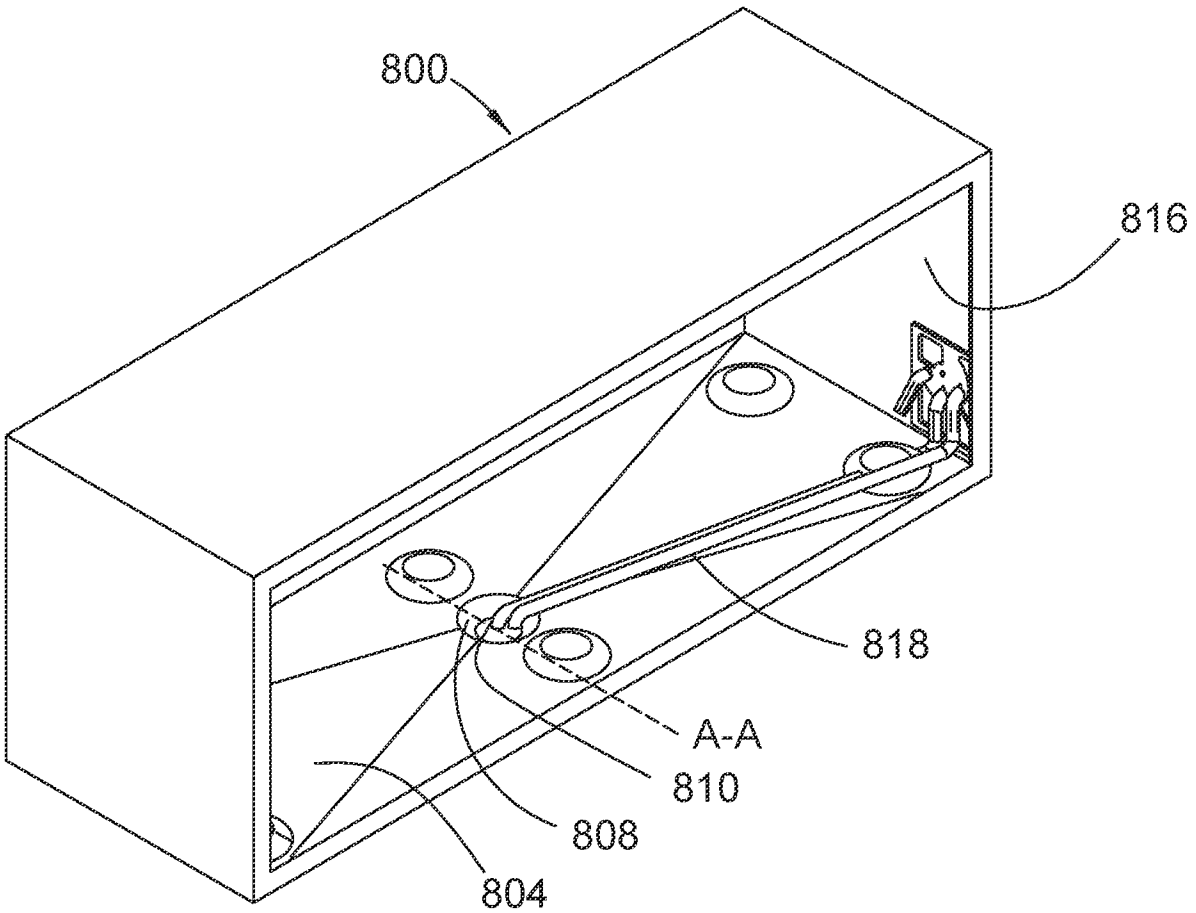
FIG. 16 shows a perspective view of a wall sleeve assembly showing an inside of the side of the wall sleeve including a pellet delivery tube for a drain reservoir of the wall sleeve, in accordance with some embodiments.

FIG. 16 shows a perspective view of a wall sleeve assembly showing an inside of the side of the wall sleeve 800 including a pellet delivery tube for a drain reservoir of the wall sleeve, in accordance with some embodiments. The wall sleeve 800 is substantially similar to that shown in FIG. 8, but includes the addition of a pellet delivery tube 818 that extends from the side wall 816 to the drain 808. However, unlike the drain access tube 810, which ends over the hole through which water drains, the end of the pellet delivery tube 818 is positioned over a floor of the reservoir created by the drain 808. The bottom 804 of the wall sleeve is sloped toward to the drain 808 from the walls or sides of the wall sleeve. As a result, condensate draining onto the bottom 804 flows into the drain 808, rather than accumulating in the bottom of the wall sleeve, as is conventional. In conventional wall sleeve, there can be on the order of one to two gallons of water that accumulates in the bottom of the conventional wall sleeve, which, if a leak occurs in the material of the wall sleeve, could result in a substantial amount of water leaking out of the wall sleeve. By sloping the bottom 804 only a small amount of water will normally accumulate, in the reservoir created by the drain 808. The pellet delivery tube 818 can deliver treatment pellets into the drain reservoir to inhibit the growth of organic matter.

Figure 17:
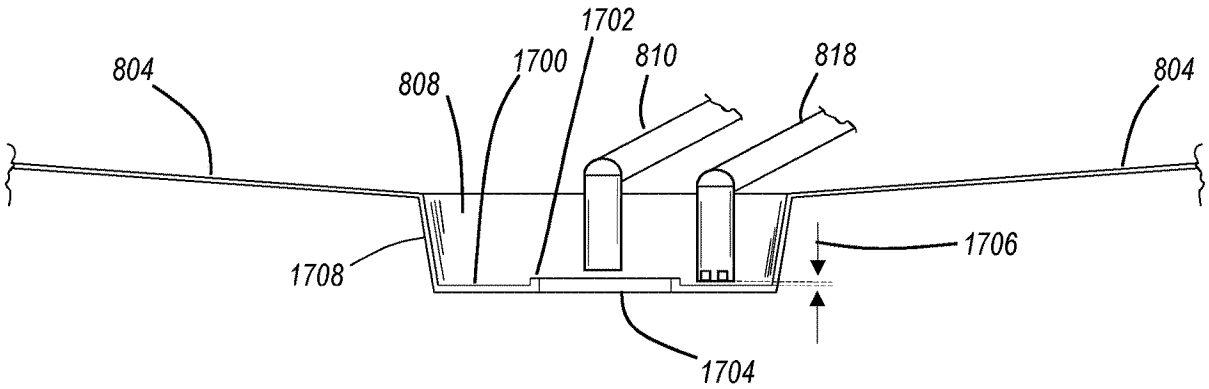
FIG. 17 shows a side partial cut-away view of a drain pan for use with a wall sleeve, in accordance with some embodiments.

FIG. 17 shows a side partial cut-away view of a drain pan for use with a wall sleeve, in accordance with some embodiments. The view here is perpendicular to the line A-A of FIG. 16, and centered on the drain pan. The bottom 804 is the surface on which water drips from other parts of the PTAC, and can be a bottom portion of the wall sleeve 800 or it can be a pan that is inserted in the bottom of a PTAC wall sleeve. As can be seen the bottom 804 slopes downward to the drain 808, which drops below the rest of the bottom 804 to create a drain reservoir, including a reservoir floor 1700, and a rim or lip 1702 around a drain opening 1704. The drain reservoir is formed by the reservoir floor 1700 and the sidewall 1708 that extends downward from the bottom 804 into the drain. The drain access tube 810 is positioned so that the end of the drain access tube is over the drain opening 1704. The pellet delivery tube 818 is positioned so that its end is over the reservoir floor 1700. The end of the pellet deliver tube 818 is spaced 1706 from the reservoir floor 1700 to allow accumulated water to flow under the end of the pellet delivery tube but not so high as to allow a pellet to escape from under the end of the pellet delivery tube 818. The water retained by the rim 1702 will dissolve the treatment pellet at the end of the pellet deliver tube 818, which can be loaded with pellets to ensure a constant, gravity-fed supply of treatment pellets. As each successive treatment pellet dissolves, which occurs slowly, over the course of several days, typically, the chemical released are distributed into the water and carried into the drain through the drain opening 1704. That is, as water continues to flow into the reservoir, it fills up the space above the reservoir floor 1700 and between the sides of the reservoir and the rim 1702, spilling over the rim 1702 and carrying treatment chemicals into the drain so as to inhibit growth of organic matter in the drain as well as in the reservoir.

Figure 18:
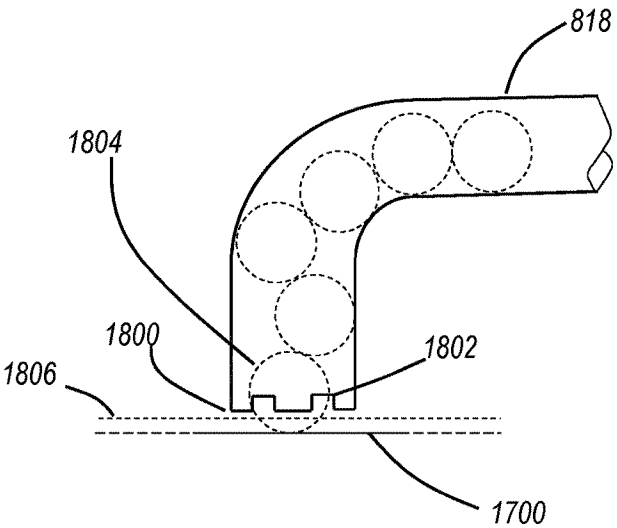
FIG. 18 shows a side view of an end of a pellet delivery tube in a drain reservoir of a drain pan for a wall sleeve, in accordance with some embodiments.

FIG. 18 shows a side view of an end of a pellet delivery tube 818 in a drain reservoir of a drain pan for a wall sleeve, in accordance with some embodiments. The pellet delivery tube connects to the side of the wall sleeve, and provides access for a user to load treatment pellets (e.g. 1804) into the tube 818 at a proximal end (with respect to the side of the wall sleeve). The distal end 1800 of the pellet delivery tube is positioned over the floor of a drain reservoir so as to capture a treatment pellet 1804 within the end 1800 of the pellet delivery tube and against the floor 1700 of the reservoir. Water 1806 will then interact with the treatment pellet 1804, causing it to dissolve and release chemicals that inhibit organic matter growth. The end 1800 of the pellet delivery tube 818 can have notches 1802 to ensure water is able to make contact with the treatment pellet 1804 but retain the treatment pellet 1804 while it is in an undissolved state. The allows the distal end 1800 to be in contact with the floor 1700, which can happen due to tolerances or the pellet delivery tube being displaced during assembly, for example. The tube can be loaded with treatment pellets as indicated. The treatment pellets 1804 can be spheroid in shape and fed into the tube 818 at the side of the wall sleeve using an access opening as previously described above for the guide structure(s). The pellets can be spheroid or spherical, allowing them to roll along the inside of the tube, as urged by gravity, or by other pellets being urged by gravity. Thus, as treatment pellet 1804 is dissolved, the next treatment pellet moves into place at the end of the tube 818 to eventually make contact with the water 1806 and also start to dissolve, providing a continuous supply of growth-inhibiting chemicals in the water collected in the drain reservoir. A user can then check the proximal end of the pellet delivery tube, and if the supply of treatment pellets in the tube is low, more can be added.

Figure 19B:
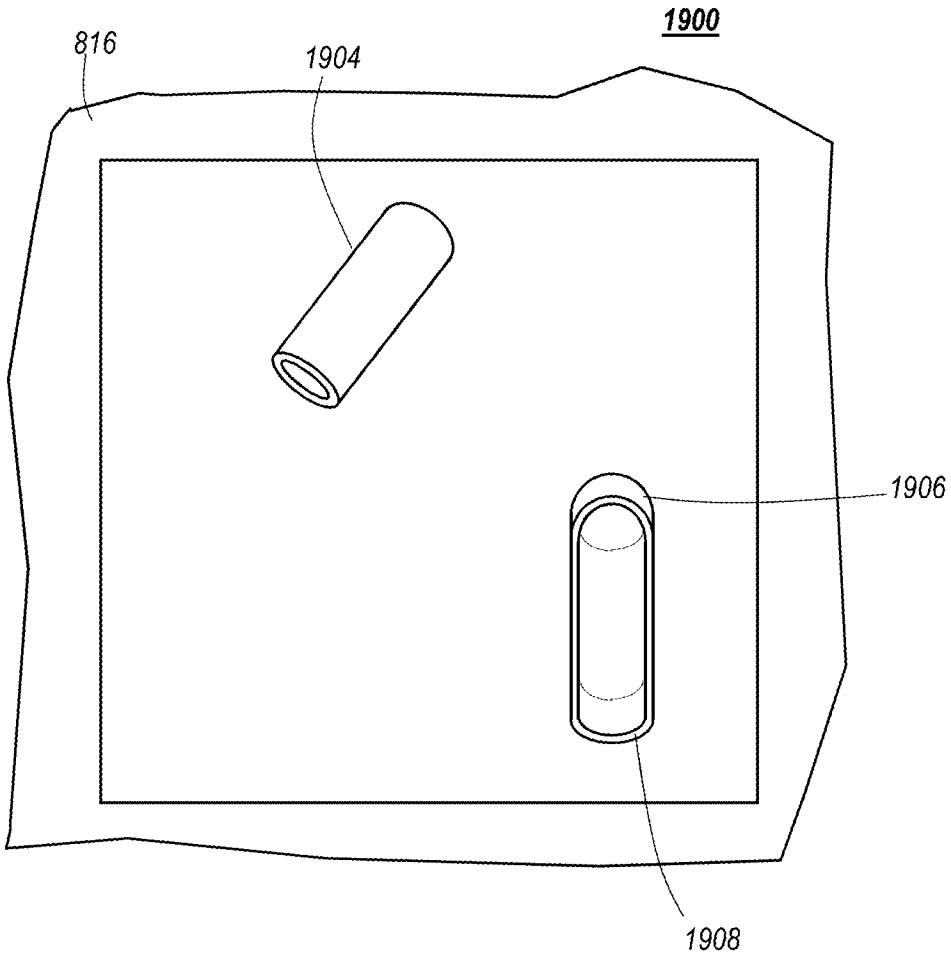
FIGS. 19A-19B show the side and front elevational views of guide structures for use with spherical or belted spheroid treatment pellets, in accordance with some embodiments.
Figure 19A:
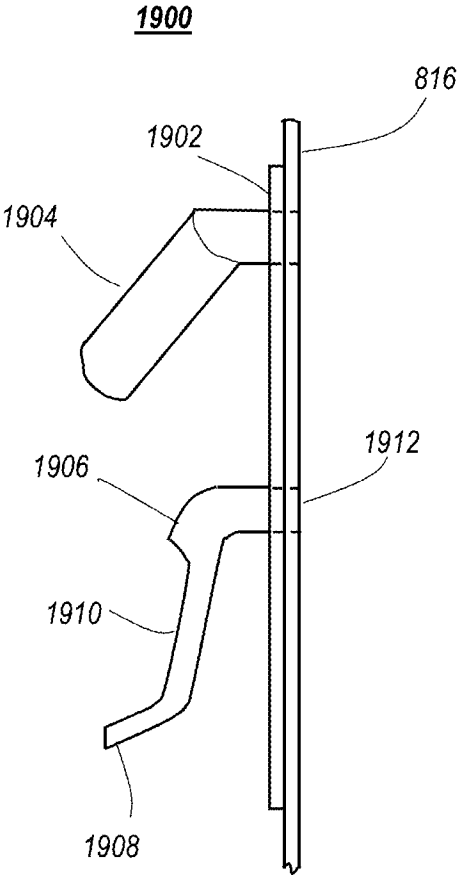

FIGS. 19A-19B show the side and front elevational views of a guide structure arrangement 1900 for use with spherical or belted spheroid treatment pellets, in accordance with some embodiments. A mounting plate 1902 can be configured to attach the side 816 of the wall sleeve of a PTAC unit. The mounting plate can support one or more guide structures. In particular a first guide structure 1904 can be configured to guide a treatment pellet inserted from the outside into a chassis pan of the PTAC unit. A second guide structure 1906 can be configured to guide a treatment pellet into the fluid or drain reservoir of a sloped drain pan or bottom of the PTAC unit. In particular, the first guide structure 1904, as shown, is configured to drop a treatment pellet directly, or near-directly, into the chassis pan. The second guide structure 1906 includes a ramp end 1908 that deviates upward from vertical, and from a down section 1910. When spherical or spheroid treatment pellet is inserted into the opening 1912 through the side 816 into the top of the second guide structure 1906, the pellet can roll to the down section 1910, increasing in velocity. The ramp end 1908 then directs the moving pellet into a more horizontal direction across the surface of the drain pan or bottom of the PTAC wall sleeve.

Figure 20C:
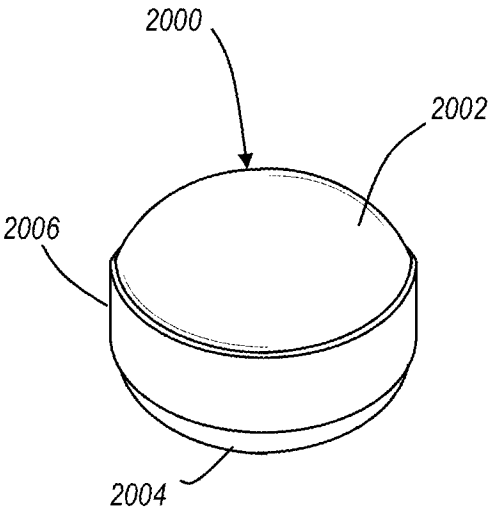
FIGS. 20A-20C show views of a belted spheroid treatment pellet, in accordance with some embodiments.
Figure 20B:
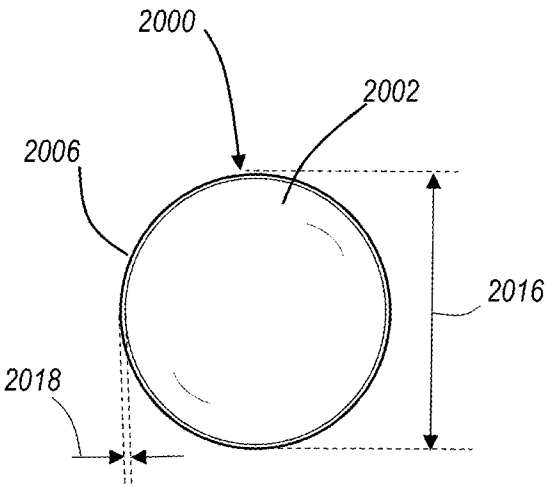
Figure 20A:
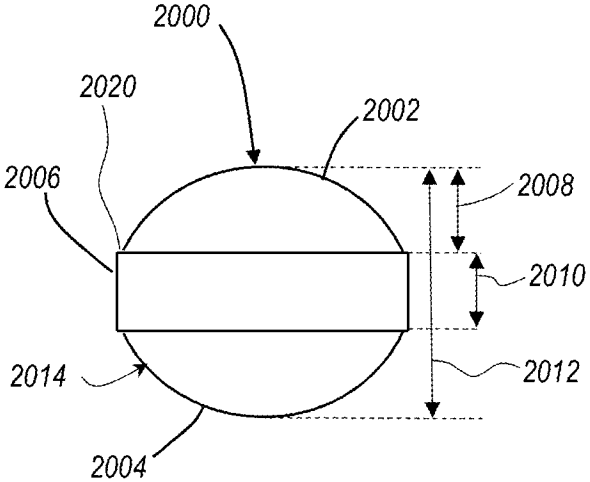

FIGS. 20A-20C show views of a belted spheroid treatment pellet 2000, in accordance with some embodiments. In addition to spherical treatment pellets, it has been found that a belted spheroid shape can also be used and provides an advantage in manufacturing. Referring generally to FIGS. 20A-20C, a belted spheroid treatment pellet 2000 is formed by a press that compresses material as a powdered under pressure sufficient to form the powder into solid mass. FIG. 20A shows a side elevational view, FIG. 20B shows a top plan view, and FIG. 20C is a top perspective view.

In testing the process, however, it was found that creating a perfectly spherical treatment pellet is difficult and a significant number of mold positions fail to produce a sufficiently compacted unit to retain the spherical shape. The provision of a cylindrical section around the middle of the unit—a belt—greatly increases the yield in molding treatment pellets and produces a pellet that can still roll sufficiently to reach the reservoir in the drain pan.

As shown, each belted spheroid treatment pellet 2000 includes a hemispherical top portion 2002 and a hemispherical bottom portion 2004. The two hemispherical portions 2002, 2004 are oriented in opposing directions and are joined to a central cylindrical section 2006 that forms a belt around the belted spheroid treatment pellet 2000. The pellet 2000 is made of a water-soluble material that inhibits the growth of various microbes known to grow in air conditioner units. The radius 2014 of the hemispherical portions 2002, 2004 can be greater than half a diameter 2016 of the pellet 2000. In some embodiments the radius 2014 of the hemispherical portions 2002, 2004 can be in the range of 0.15 to 0.25 inches, or more or less than that in some embodiments. The diameter 2016 can be on the order of 0.35 to 0.45 inches in some embodiments, and more or less than that in some embodiments. The belt height 2010 can be in the range of 0.08 to 0.12 inches in some embodiments, and more or less than that in some embodiments. The height of the hemispherical portions 2002, 2004 from the belt 2006 can be in the range of 0.09 to 0.13 inches in some embodiments, and more or less than that in some embodiments. In some embodiments the cylindrical belt section 2006 can extend outward from the hemispherical portions 2002, 2004 to create a land that has a width of 0.004 to 0.008 inches in some embodiments, and more or less than that in some embodiments. In some embodiments the pellet 2000 can have the following dimensions, with a toleration of +1-0.003 inches: diameter 2016 of 0.375 inches, belt height 2010 of 0.107 inches, hemispherical portion height 2008 of 0.119 inches, and land width 2018 of 0.006 inches. A height 2012 between the peaks of the hemispherical portions 2002, 2004 can be less than a diameter 2016 of the cylindrical section 2006.

Figure 21:
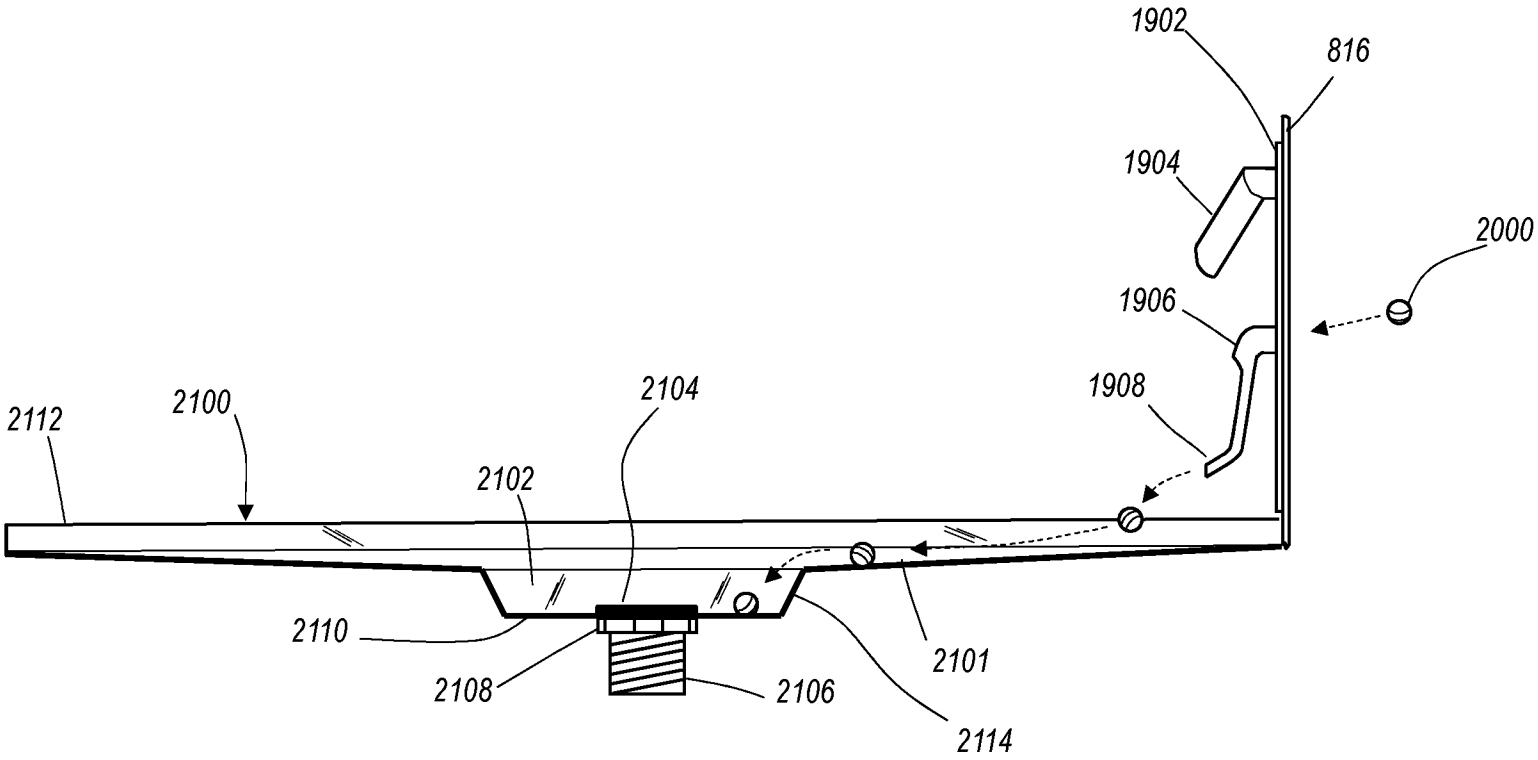
FIG. 21 shows a side partial cut-away view of a drain pan for use with a wall sleeve, in accordance with some embodiments.

Although the belted spheroid pellet 2000 is not perfectly spherical, when dropped through a guide structure such as second guide structure 1906 of FIG. 19A-B, the momentum achieved, combined with a slope in the drain pan, will result in the pellet 2000 rolling to the water reservoir, which is shown in FIG. 21. In FIG. 21 there is shown a side partial cut-away view of a drain pan 2100 for use in a wall sleeve, in accordance with some embodiments. The drain pan 2100 can be a separate part that is inserted into the wall sleeve (e.g. 800) or it can be integrally formed as the bottom of the wall sleeve. As shown here, the chassis is not shown for the sake of clarity. The drain pan 2100 has a sloped bottom surface 2101 that slopes from the outer sides or edges to a centrally located drain reservoir 2102. The sloped bottom 2101 can be surrounded by a wall 2112, and directs condensate (water) to flow into the drain reservoir 2102, where it will then flow into a drain member 2106 once the water level rises above the top of a drain rim 2104. The drain member is a tube-like member that is open at the top and bottom to allow water to drain through it. The drain member 2106 can have a threaded portion over which a threaded collar 2108 is adjusted to bear against the bottom of the drain pan in the reservoir, and causing the drain rim 2104 to bear against the top of the drain pan bottom, thereby creating a water tight seal. In some embodiments the diameter of the drain member 2106 can be smaller than a drain pipe in which the bottom of the drain member 2106 is disposed, leaving room between the drain member 2106 and the drain pipe so that, even if the seal between the rim 2104, collar 2108 and the drain pan leaks the water will still flow down the outside of the drain member 2106 into the drain pipe.

By sloping the bottom if the drain pan 2000, water will only stand in the bottom 2110 of the reservoir 2102 between the drain rim 2104 and the reservoir wall 2114. As a result, a volume of water on the order of ounces may be retained, rather than closer to a gallon in some prior art PTAC units. As microbial growth can occur where there is sufficient water, it is desirable to treat the drain reservoir 2102 in order to inhibit, if not prevent microbial growth. A treatment pellet 2000 can be inserted through the side 816 of the wall sleeve into the second guide structure 1906 to follow a path indicated by dashed arrow. As the pellet 2000 follows the shape of the second guide structure 1906 in a mostly vertical direction it gains velocity, and is then guided to more of a horizontal direction by the ramp end 1908. The pellet 2000 will then roll across the bottom 2101 into the reservoir 2102 where it will slowly dissolve in water, thereby distributing the microbial growth inhibiting material into the standing water in the drain reservoir 2102 and into the drain. The angle of the slope encourages the belted spheroid pellet to roll to the reservoir 2102, and can be, in some embodiments, in the range of four to twenty degrees relative to a plane defined by the perimeter of the floor.

Figure 22:
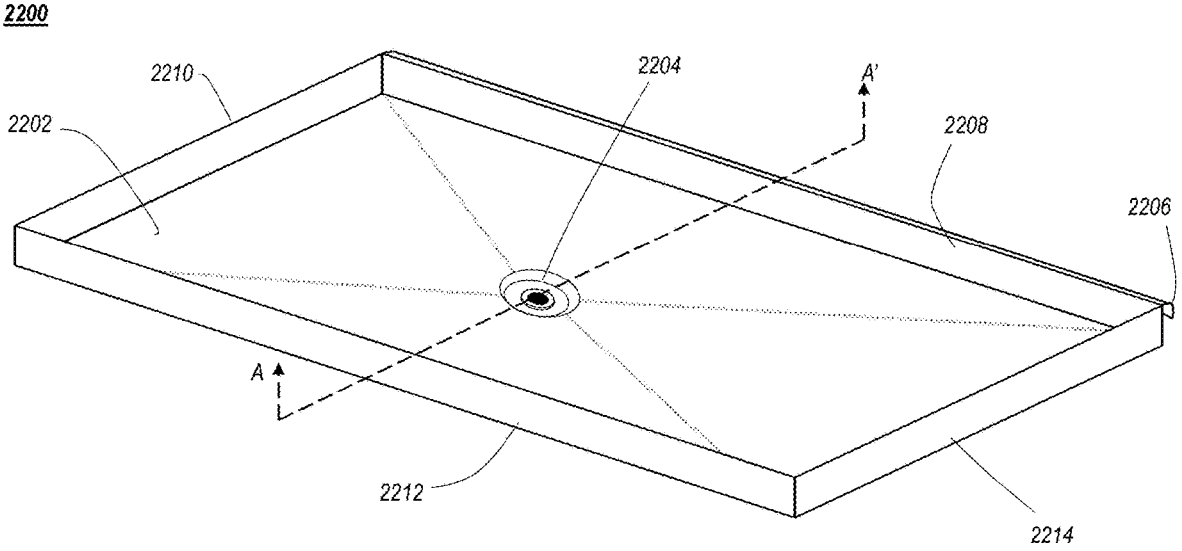
FIG. 22 is a perspective view of a drain pan for use with a wall sleeve, in accordance with some embodiments.

FIG. 22 is a perspective view of a drain pan 2200 for use with a wall sleeve, in accordance with some embodiments. The drain pan 2200 includes a floor 2202 that slopes downward from the side walls 2208, 2210, 2212, 2214 to a drain reservoir 2204 that forms the lowest point of the floor 2202, and which extends downward from the main portion of the floor 2202. The drain reservoir 2204 can have a depth of about one inch from the main portion of the floor 2202 where in meets the drain reservoir 2204. The drain reservoir can further have a width from front to back (in the direction from front wall 2212 to back wall 2208) of two to four inches. Similarly, the drain reservoir 2204 can have a width, in a direction from side wall 2210 to side wall 2214, of two to four inches. In some embodiments the width of the drain reservoir 2204 can be larger or smaller. The drain reservoir 2204 is positioned at the lowest point of the floor 2202 so that water produced by the AC unit that drains in the drain pan will flow down the sloped floor 2202 to the drain reservoir 2204. Likewise, treatment pellets introduced into the wall sleeve can roll down the sloped floor 2202 into the drain reservoir 2204 where they will be dissolved the standing water held therein. Thus, the drain reservoir 2204 uses a raised lip or ridge 2304 around the drain opening, such as rim 1702 of FIG. 17. The back wall 2208 can include an overhang lip 2206 that extends to the rear and then downward, to engage wall portion of the louver cover that is placed on the outside of the PTAC unit.

Figure 23:
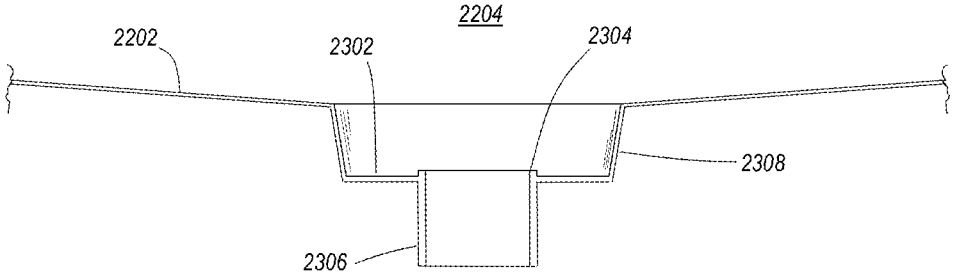
FIG. 23 is a partial side cut-away view of a drain pan such as that shown in FIG. 22 showing a integrally formed drain structure to retain some water in a reservoir, in accordance with some embodiments.

FIG. 23 is a partial side cut-away view of a drain pan 2200 such as that shown in FIG. 22 showing an integrally formed drain reservoir 2204 to retain some water in a reservoir, in accordance with some embodiments. The floor 2202 of the drain pan slopes downward toward the drain reservoir 2204. The drain reservoir is formed by a wall 2308 that surrounds a space bounded at a bottom by a reservoir floor 2302. A rim 2304 forms a small barrier around a drain opening. As shown here the drain opening is in a middle region of the reservoir floor 2302, but can be located at a side, equivalently. The rim 2304 creates a barrier so that some water is retained on the reservoir floor 2302 to dissolve treatment pellets. A drain extension 2306 extends downward from the bottom of the drain reservoir 2204, and has a circular diameter sized to couple with a drain fitting. The features shown here in drain pan 2200 are intended to be portions of a one-piece molded drain pan to facilitate high volume manufacturing. However, an equivalently functioning drain pan can be formed using discrete parts that result in substantially similar shapes of the features shown here.

Figure 24:
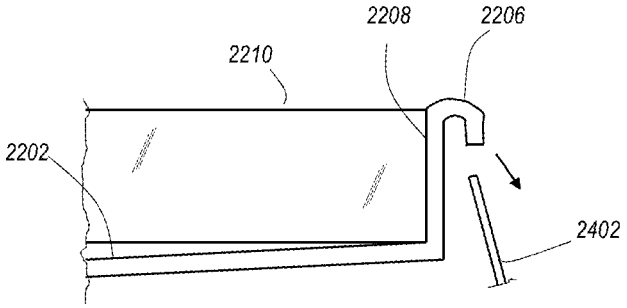
FIG. 24 is a partial side cut-away view of the rear of a drain pan for use with a wall sleeve, showing a leak preventing overhang lip, in accordance with some embodiments.

FIG. 24 is a partial side cut-away view of the rear of a drain pan 2200 for use with a wall sleeve, showing a leak preventing overhang lip, in accordance with some embodiments. In particular, the view here is along cut line A-A' of FIG. 22. The back wall 2208 includes an overhang lip 2206 that extends to the rear, and downward, creating a groove or slot in which the top edge of a wall segment 2402 of the wall sleeve 2600 can be captured. The overhang lip 2206 runs substantially the length of the back wall 2208, and prevents water, such as rain, going between the wall segment 2402 and the back wall 2208 of the drain pan 2200. Thus, the overhang lip 2206 prevents such leakage and can obviate the need for caulking.

Figure 25:
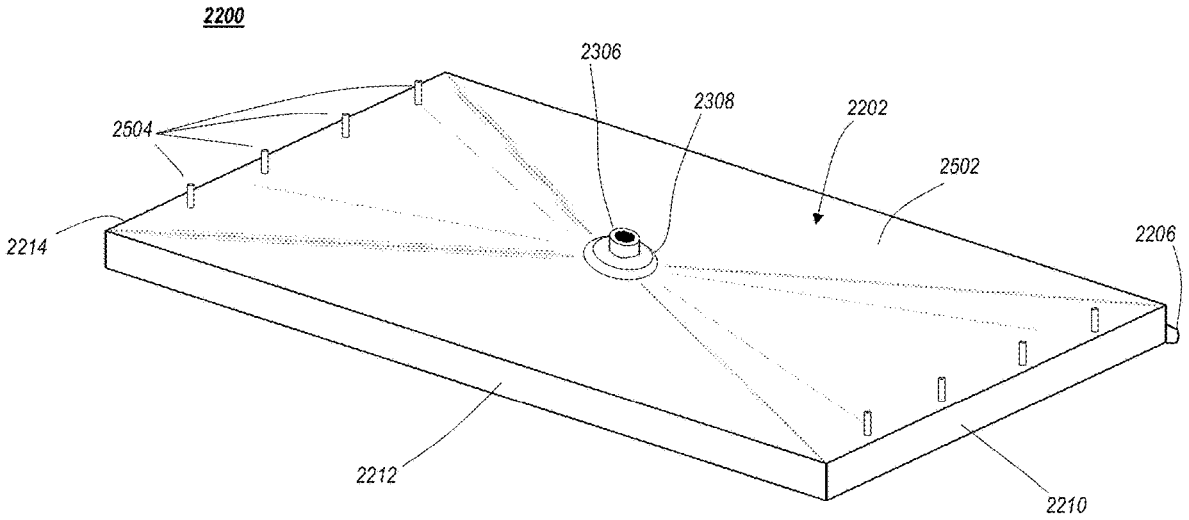
FIG. 25 is a perspective view of the bottom of a drain pan such as that shown in FIG. 22, in accordance with some embodiments.

FIG. 25 is a bottom inverted perspective view of the bottom of a drain pan 2200 such as that shown in FIG. 22, in accordance with some embodiments. The drain pan 2200 is shown inverted here to show a bottom view. The floor 2202 of the drain pan 2200 has a bottom surface 2502. Extending from the bottom surface 2502 are several integrally formed staking protrusions 2504. The staking protrusions mate with corresponding holes in the wall sleeve and allow the drain pan 2200 to be staked into the wall sleeve.

The staking protrusions 2504 can be located on the bottom surface 2502 along the sides bounded by side walls 2210, 2214.

Figure 26:
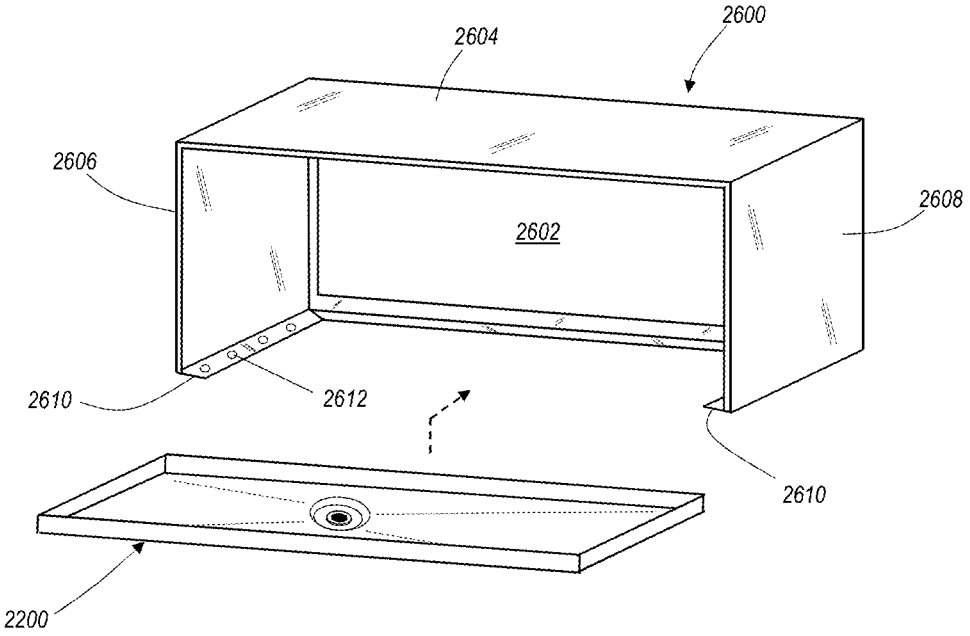
FIG. 26 is an exploded perspective assembly view of a drain pan and wall sleeve, where the drain pan is staked into the wall sleeve, in accordance with some embodiments.

FIG. 26 is an exploded perspective assembly view of a drain pan 2200 and wall sleeve 2600, where the drain pan 2200 is staked into the wall sleeve, in accordance with some embodiments. The wall sleeve 2600 has substantially similar dimensions as wall sleeve 800 and fits into a standard PTAC wall opening. However, unlike wall sleeve 800, wall sleeve 2600 does not have a floor/drain pan. The wall sleeve 2600 can be made of sheet metal, while the drain pan 2200 can be molded of a polymeric material. The advantage is that wall sleeve 2600 can be made using simple folds as it has all flat surfaces. Thus, the bottom does not have to be stamped or formed to create the features necessary to provide the sloped floor, drain reservoir, and rim around the drain opening. Instead, the drain pan 2200 can be a separately formed member that is molded of polymeric material, eliminating the stamping necessary to form sheet metal. Further, by eliminating fold seams in the floor, the drain pain 2200 has no seams that can leak.

The wall sleeve 2600 has a top 2604, and opposing vertical sides 2606, 2608, and is open at the front. Further, the wall sleeve 2600 has an opening 2602 at the back. The bottoms 2610 of the sides 2606, 2608 can be folded inward, and have a series of holes/apertures 2612 corresponding to the staking protrusions 2504, which pass through the holes 2612. The opposing vertical sides 2606, 2608 are parallel to each other and extend from the front of the wall sleeve 2600 to the back of the wall sleeve 2600. The top 2604 extends from the top of one vertical side 2606 to the top of the other vertical side 2608, and from the front to the back of the wall sleeve 2600.

Figure 27A:
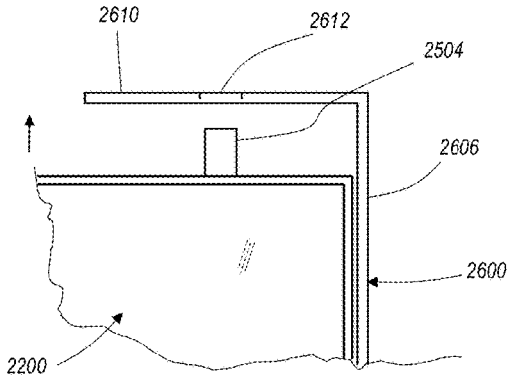
FIGS. 27A-D show various stages of staking a drain pan into a wall sleeve, in accordance with some embodiments.
Figure 27B:
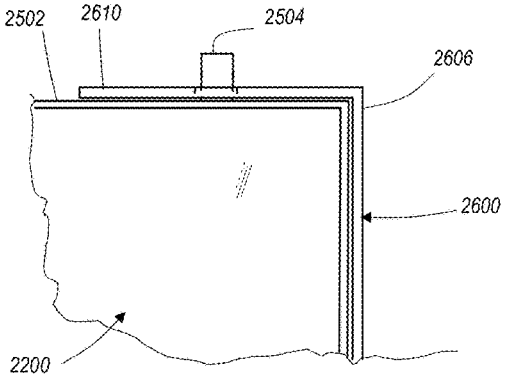
Figure 27C:
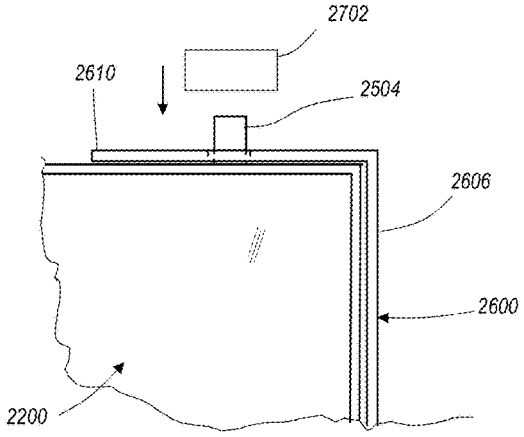
Figure 27D:
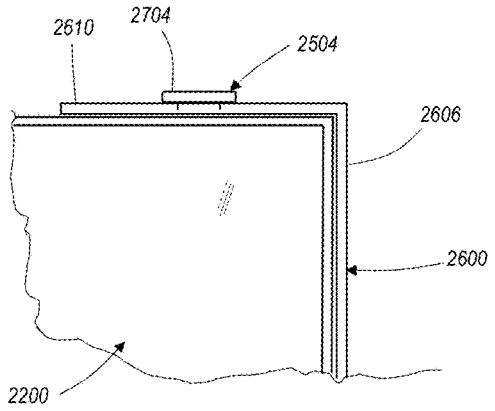

FIGS. 27A-D show various stages of staking a drain pan into a wall sleeve, in accordance with some embodiments. As shown here, the wall sleeve 2600 and drain pan 2200 are inverted from their orientations of FIG. 26. This is because, in assembling the drain pain 2200 into the wall sleeve 2600 it is easier to perform the staking in the inverted orientation used here. In FIG. 27A, the drain pan 2200 is moved into the wall sleeve 2600 such that staking protrusions 250 are aligned with openings 2612. The drain pain 2200 and/or the wall sleeve 2600 are then moved into the position of FIG. 27B where the staking protrusions 2504 are through the openings 2612, and the bottom surface 2502 is against the bottom 2610 of the wall sleeve. In FIG. 27C a heat element 2702 is moved into contact with each of the staking protrusions 2504. The heal element softens and deforms the staking protrusion 2504 to reduce its height and flatten/spread out the material of the staking protrusion beyond the diameter of the opening 2612. When the deformed material of the staking protrusion cools, it hardens, proving a retaining function similar to that of a rivet, as shown in FIG. 27D. Once each of the staking protrusions 2504 is heat staked, the drain pan 2200 is assembled into the wall sleeve 2600 to provide an assembled PTAC wall sleeve.

Figure 28:
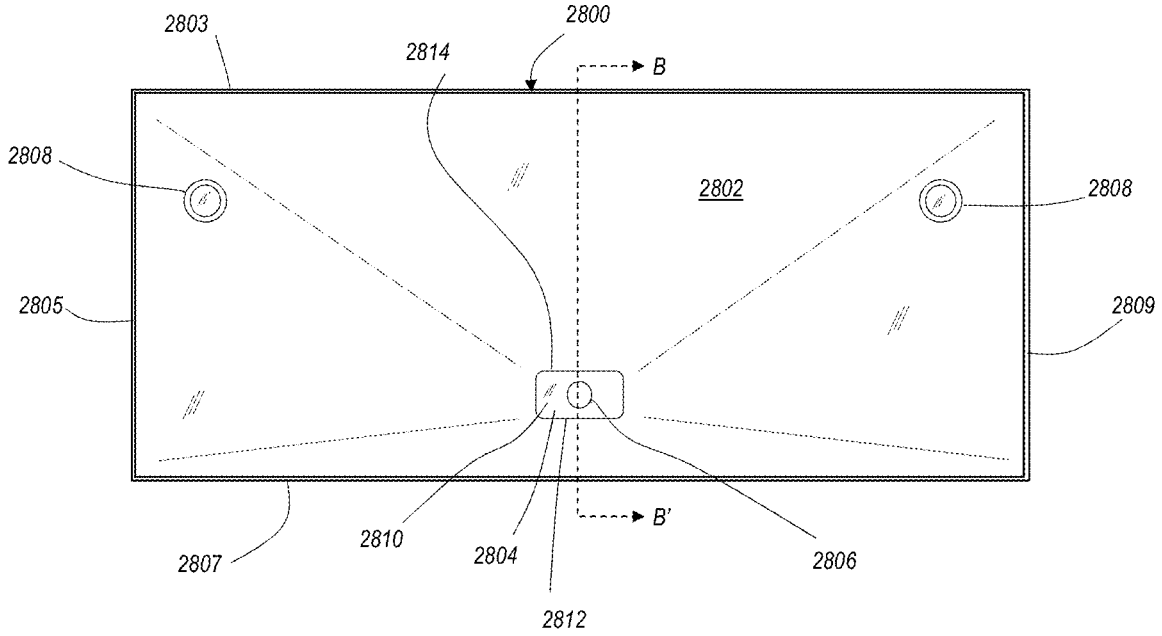
FIG. 28 shows a top plan view of a drain pan having a drain reservoir positioned to properly locate the drain pan/wall sleeve assembly in a wall, in accordance with some embodiments.
Figure 29:
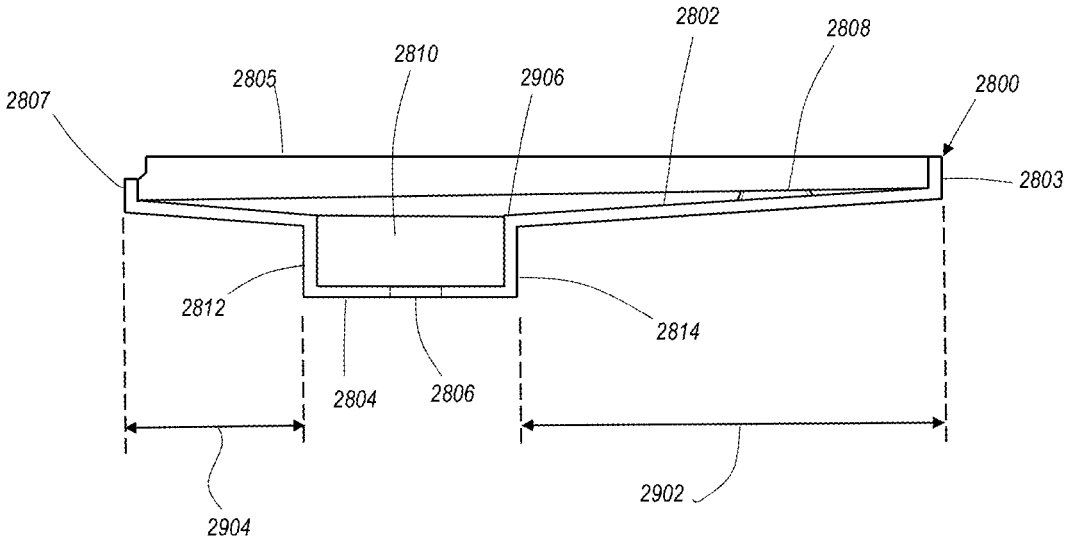
FIG. 29 shows a side cutaway view of a drain pan such as that shown in FIG. 28, in accordance with some embodiments.

FIG. 28 shows a top plan view of a drain pan 2800 having a drain reservoir 2810 positioned and shaped to properly locate the drain pan/wall sleeve assembly in a wall, in accordance with some embodiments. FIG. 29 shows a side cutaway view of a drain pan 2800 viewed in the direction of line B-B'. The floor 2802 of the drain pan 2800 is sloped downward from the sides 2803, 2805, 2807, 2809 at the perimeter of the floor 2802 to the reservoir 2810 so that water condensing in the AC unit that is collected by the floor 2802 flows into the reservoir 2810. Further, the angle of the slope is selected such that the belted spherical treatment pellets as shown in FIGS. 20A-C will often, but not necessarily always, roll to the reservoir 2810 when introduced into the PTAC through guide structure such as that shown in FIG. 21. In some embodiments the angle is in the range of four to twenty degrees to encourage treatment pellets to roll to the reservoir 2810 after being introduced into the drain pan through a guide structure, which gives the treatment pellets some velocity.

The reservoir 2810 can be formed by a portion of the floor 2802 that extends downward from the floor 2802, and surrounds a volume/space. The bottom 2804 of the reservoir 2810 is lower than any other portion of the floor 2802, and the top 2906 of the sides of the reservoir 2810 that turn downward from the floor 2802 are generally the lowest point of the floor outside of the reservoir 2810. The reservoir 2810 can have a drain opening 2806 for water to exit the drain pan. The drain opening 2806 can have a rim around it, as rim 2304 in FIG. 23, or a small rim can be formed by a drain connector that fits into and through the drain opening 2806. Likewise, the drain opening can include a drain extension like drain extension 2306 of FIG. 23 that in integrally formed on the bottom of the drain pan 2800 around, and extending downward from the drain opening 2806. The floor 2802 of the drain pan 2800 can have several standoffs 2808 that function to support the PTAC chassis in the same manner as standoffs 806.

As can be seen in FIG. 28, the front and back of the reservoir 2810 are flat. The back side 2814 the reservoir 2810 is flat and parallel to the back and front sides 2803, 2807, as is the front side 2812 of the reservoir 2810. More importantly, the reservoir 2810 is positioned such that the back side 2814 will make contact with the wall through which the PTAC unit is mounted and act as a guide. Thus, when the wall sleeve in which the drain pan 2800 is mounted is installed in a wall opening, the wall sleeve is inserted into the wall opening from the inside (e.g. interior space) towards the outside (e.g. outdoors) until the back side 2814 of the reservoir 2810 meets the wall below the wall opening. As indicated in FIG. 29, a distance 2902, which is the distance from that back side 2803 of the drain pan 2800, which will be substantially co-terminal with the back of the wall sleeve, is selected such that the wall sleeve will be properly positioned in the wall opening, laterally, and extend to the outside a correct distance. In other words, when installing the wall sleeve with drain pan 2800, when the back side 2814 of the reservoir 2810 makes contact with the interior wall, the wall sleeve will be in the optimum position to mount the wall sleeve and PTAC unit. Furthermore, the front 2812 of the reservoir 2810 is positioned a distance 2904 from the front side 2807 of the drain pan 2800 such that a sub-base installed under the front of the wall sleeve/PTAC unit will contact the front side 2812 of the reservoir and will be properly aligned under the wall sleeve.

Figure 30:
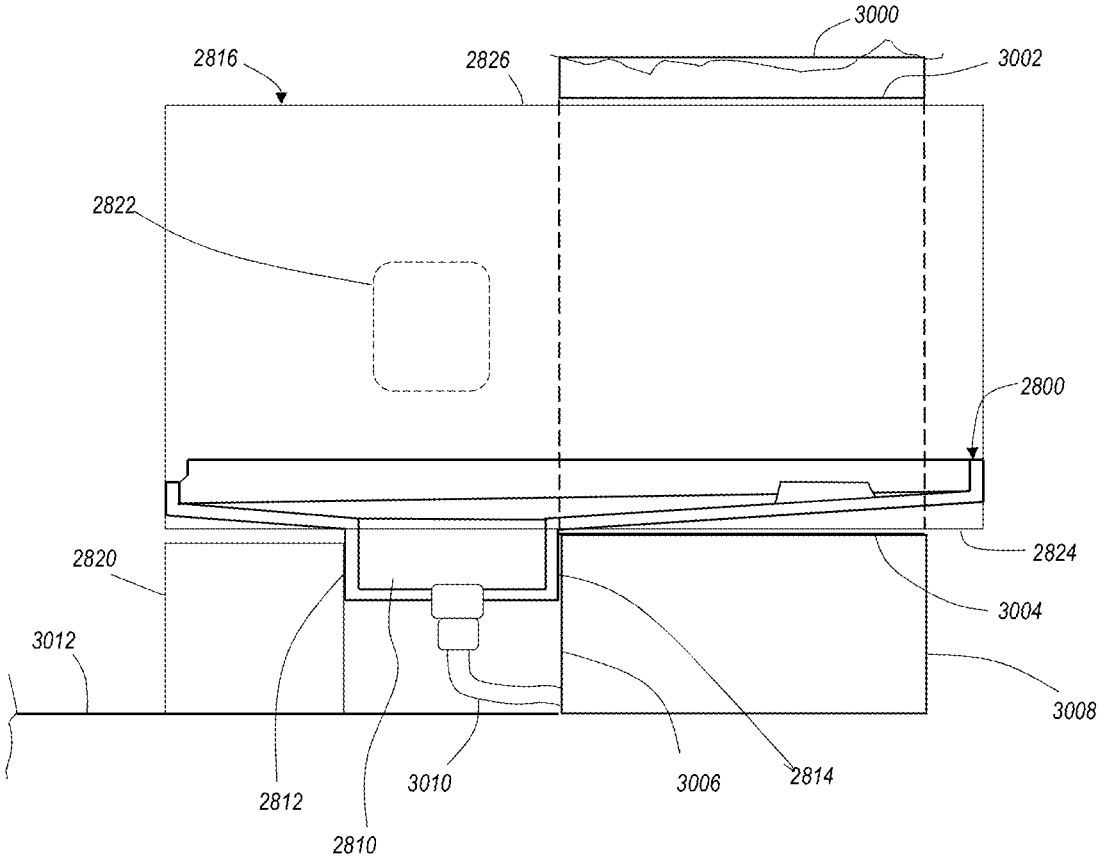
FIG. 30 shows a drain pan/wall sleeve assembly installed in a wall, in accordance with some embodiments.

FIG. 30 shows a drain pan 2800 in a wall sleeve 2816 installed in a wall 3000, in accordance with some embodiments. The wall sleeve 2816 is installed through a wall opening in the wall 3000 that has a top 3002 and a bottom 3004. A top 2826 of the wall sleeve is adjacent the top 3002 of the opening in the wall 3000. The wall 3000 meets a floor 3012, and has an outside 3008 and inside 3006. For clarity, the chassis, which contains the various AC system components, is not shown here. As can be seen the back 2824 of the wall sleeve 2816 extends to the outside of the wall 3000. As installed, the back side 2814 of the reservoir 2810 is against the inside 3006 of the wall 3000 below the wall opening. A drain tube 3010 is coupled to the drain opening of the reservoir 2810. A sub-base 2820 is installed under the front of the wall sleeve 2816 and can be against the front side 2812 of the reservoir 2810. Area 2822 indicates an access area that allows a user to insert treatment pellets into the PTAC unit. It should be understood, although stated hereinabove, that the drawing here is not necessarily correctly proportioned or to scale, rather the drawing is configured to explain the structures involved and their relationships.

Figure 31:
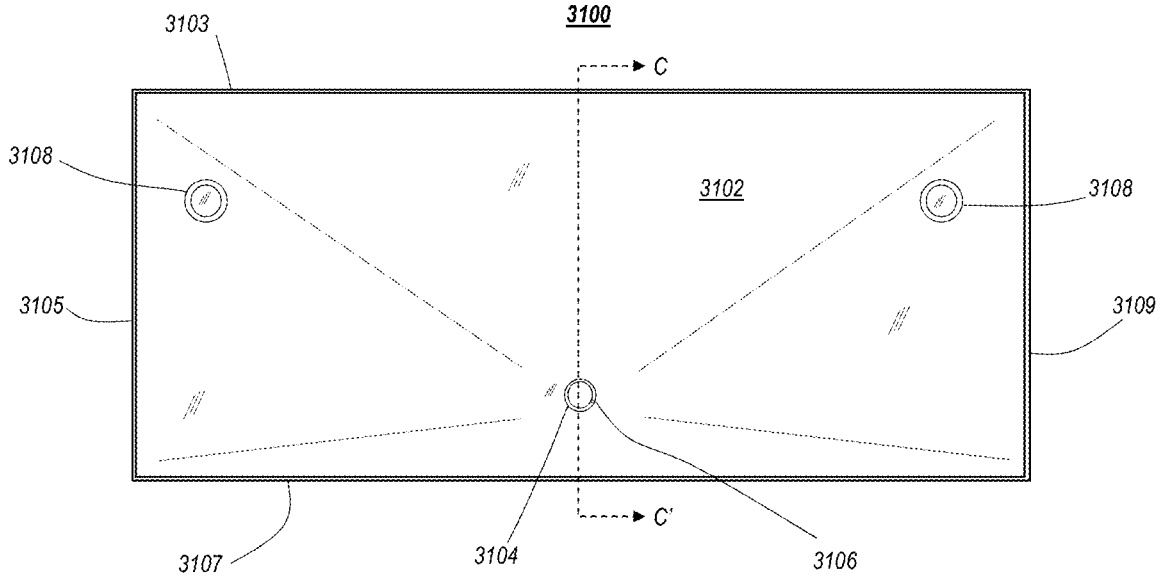
FIG. 31 shows an overhead view of an equivalent alternative arrangement for the drain pan/floor of the PTAC wall sleeve, in accordance with some embodiments.
Figure 32:
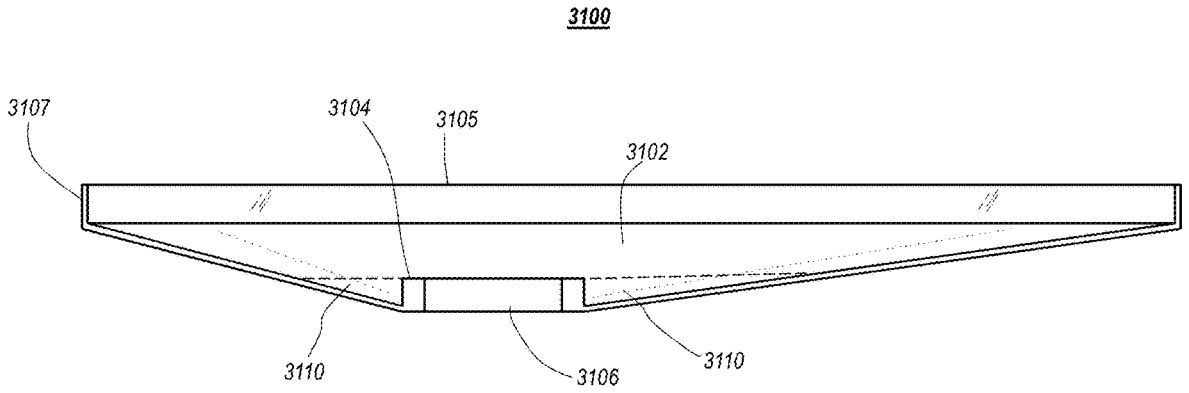
FIG. 32 shows a side cutaway view of a drain pan such as that shown in FIG. 31, in accordance with some embodiments.

FIGS. 31 and 32 show an equivalent alternative arrangement for the drain pan/floor 3100 of the PTAC wall sleeve, in accordance with some embodiments. FIG. 32 shows a side cut-away view along line C-C'. Briefly, the drain pan 3100 has a back wall 3103, a first side wall 3015, a front wall 3107, and a second side wall 3109. One or more standoffs 3108 can be formed in the floor 3102. The walls 3103, 3105, 3107, 3109 are located at the perimeter of the floor 3102 and are extend vertically above the perimeter of the floor 3102. The floor 3102 is sloped downward from the perimeter of the floor to a drain opening 3106. The drain opening 3106 is surrounded by a rim that extends above the floor 3102 where the floor 3102 meets the drain opening 3106. This results in a reservoir 3110 being formed around the rim 3104. The rim 3104 acts as a dam, causing water to collect around the rim 3104 until the level of the water exceeds the height of the rim 3104. The rim 3104 also stops treatment pellets from rolling through the drain opening 3106. A drain extension can be provided around the drain opening that extends downward before the floor 3102 and rim 3104, as described previously.

Figure 33:
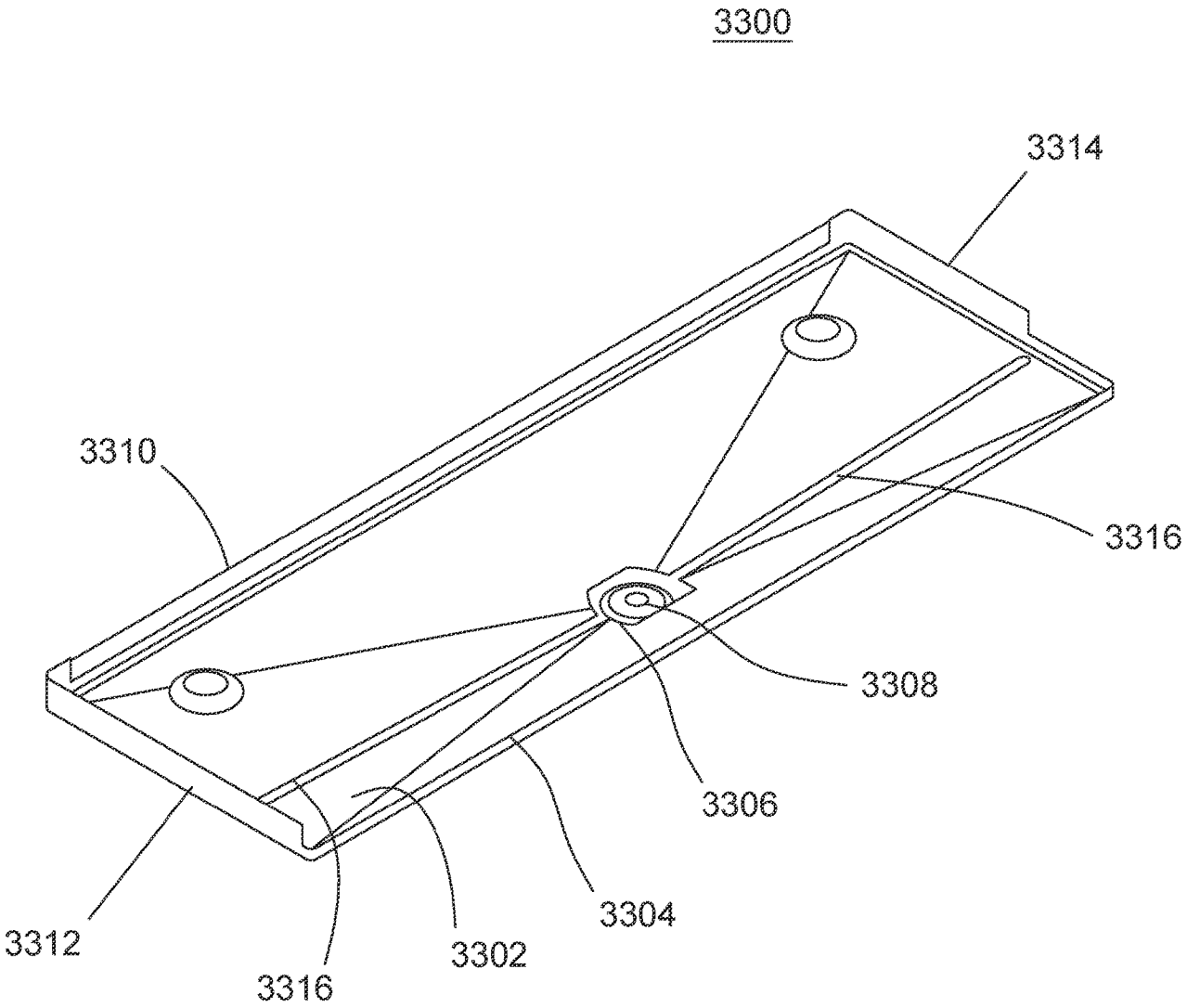
FIG. 33 shows a perspective view of a drain pan for a PTAC wall sleeve having storm overflow prevention features, in accordance with some embodiments.

FIG. 33 shows a perspective view of a drain pan 3300 for a PTAC wall sleeve having storm overflow prevention features, in accordance with some embodiments. It has been found that, in some regions, heavy rains and winds can occur, and depending on the direction of the wind, and possibly the PTAC having been installed in a non-level state, the wind can blow rain water into the PTAC, and it can blow water already in the drain pan even when there is no rain. As a result, water can, in prior art drain pans, be blown over the front of the drain pan, leaking into the inside of the structure.

To prevent such wind/rain-induced overflow, the drain pan 3300 includes a sloped floor 3302 as shown, for example, in FIG. 32, which slopes down to a drain reservoir 3306 from the sides of the drain pan 3300, which are bordered by the front wall 3304, back wall 3310, and side walls 3312, 3314. The front wall 3304 has a front wall height and the back wall 3310 has a back wall height that is taller than the front wall height. The first side wall 3312 has a height that is equal to the back wall height. The second side wall 3314 has a back portion 3318 that adjoins the back wall 3310 and has a height equal to the back wall height, and has a front portion 3320 that adjoins the front wall 3304 that has a height equal to the front wall height. The drain reservoir includes a riser or rim 3308 to ensure a small amount of water, under normal operation, is collected in the drain reservoir 3306. Water from outside the PTAC that is blown into the PTAC unit can collect in the drain pan and be blown around the drain pan without flowing into the reservoir 3306, even with a sloped floor 3302. To catch and direct such wind-blown water into the drain reservoir 3306, the floor 3302 of the drain pan 3300 includes a pair of lateral canals 3316 that extend lengthwise across the floor 3302, from opposite sides of the reservoir 3306 to the respective sides 3312, 3314. The canals 3316 can be on the order of three quarters of an inch across and about three eighths of an inch deep, and they otherwise follow the slope of the floor 3302 along the floor 3302 from the sides 3312, 3314 to the drain reservoir 3306. The canals 3316 collect wind-blown water that might otherwise be forced out of the pan and leak into the structure. The geometry of the canals 3316 removes force of the wind on the water, allowing the water to flow into the reservoir 3306 and through the drain. Although the canals 3316 are shown parallel to the front 3304 and back 3310, they can extend in other directions as well. In some embodiments the canals 3316 can be formed along the facet lines on the sloped floor 3302, which extend from each of the corners to the drain reservoir 3306.

A wall sleeve for a PTAC unit and a PTAC unit using the wall sleeve has been described that provides an external access port coupled with internally mounted guide structures that allow the provision of treatment pellets into the internal drain pan(s) of the PTAC unit without having to disassemble the PTAC unit. The embodiments of the inventive disclosure greatly simplifies routine maintenance to prevent growth and build-up of microbial matter than can foul internal components of the PTAC unit, which can reduce efficiency, and which can further block or obstruct drainage, resulting in leakage outside of the air conditioner unit that can damage interior structure, facilitate mold growth, and other issues associated with water leakage. By providing a simple and easy way to place treatment pellets into the PTAC unit, the PTAC unit does not have to be partially disassembled to place treatment pellets into the PTAC unit drain structures. This helps ensure that regular maintenance of PTAC units will be followed, and it greatly reduces the time needed to perform such maintenance.

Further, the wall sleeve is disclosed as having a bottom that acts as a drain pan. The bottom of the wall sleeve can be formed integrally with the other walls/side of the wall sleeve, or it can be made as a separate element that is assembled together into the wall sleeve. The drain pan provides a surface that acts to catch and direct water to a reservoir formed in the floor of the drain pan. The reservoir holds a small amount of water in order to allow treatment pellets to dissolve without falling into the drain, so as to produce a small volume of treated water that is eventually flushed into the drain system connected to the drain pan. The floor of the drain pan slopes downward from the sides of the drain pan to the reservoir, so that water falling anywhere on the floor of the drain pan will flow to the reservoir. The reservoir can have a rim around the drain opening to ensure that there will be a small amount of standing water in the bottom of the reservoir, and to prevent treatment pellets from rolling into the drain. When a treatment pellet sits in the standing water that is collected in the bottom of the reservoir, it dissolves, creating a treatment solution in the standing water of a specific concentration based on the rate of dissolution of the treatment pellet and the volume of water in the bottom of the reservoir. As water continues to collect in the bottom of the reservoir, the level of the standing water in the bottom of the reservoir will exceed the level or the rim around the drain opening, allowing the treatment solution to flow into the drain. Further, the reservoir can be shaped and positioned on the floor of the drain pan to aid in properly locating the wall sleeve in the wall opening when the wall sleeve is inserted into the wall opening. A substantial benefit of the sloped drain pan is that the amount of water collected in the reservoir is much less than the amount of water collected in a flat-bottomed drain pan, which reduces the volume of water collected in the drain pan by the reservoir compared to conventional flat-bottomed drain pans. As a result, if there is a leak or spill, the initial amount of water that could exit the drain pain into the structure is much less than can occur with a conventional flat-bottomed drain pan.

What is claimed is:

1. A wall sleeve drain pan for a wall sleeve of a packaged terminal air conditioner (PTAC) that is configured to receive a PTAC chassis including a chassis drain pan, the wall sleeve having opposing vertical sides, each of the opposing vertical sides having a bottom that extends inward, the wall sleeve drain pan comprising:

a plurality of side walls;

a floor having a perimeter bounded by the plurality of side walls;

a reservoir formed in the floor that extends downward from the floor and includes a drain opening having a raised rim formed around the drain opening, the raised rim having a height such that a top of the raised rim is above a bottom of the reservoir and below the floor where the floor meets the reservoir;

wherein the floor slopes downward from the perimeter to the reservoir, and wherein the drain pan is configured to be inserted into the wall sleeve and act as a bottom of the wall sleeve; and wherein the wall sleeve drain pan is configured to sit on the bottoms of the opposing vertical sides of the wall sleeve under the chassis drain pan and receive condensate from the chassis drain pan.

2. The wall sleeve drain pan of claim 1, further comprising a first canal and a second canal, the first canal formed in the floor of the wall sleeve drain pan and extending from the reservoir to the first side wall of the wall sleeve drain pan; the second canal formed in the floor of the wall sleeve drain pan and extending from the reservoir, opposite the first canal, to the second side wall of the wall sleeve drain pan, and wherein the first and second canals are parallel to the front side and back side.

3. The wall sleeve drain pan of claim 1, wherein the reservoir is centrally located between the first side wall and the second side wall.

4. The wall sleeve drain pan of claim 1, wherein:

the front wall has a front wall height;

the back wall has a back wall height that is taller than the front wall height;

the first side wall has a height that is equal to the back wall height; and the second side wall has a back portion that adjoins the back wall and has a height equal to the back wall height and a front portion that adjoins the front wall that has a height equal to the front wall height.

5. A wall sleeve drain pan for a wall sleeve of a packaged terminal air conditioner (PTAC), the wall sleeve configured to receive a PTAC chassis having a chassis drain pan and the wall sleeve having opposing vertical sides, each of the opposing vertical sides having a bottom that is folded inward, the wall sleeve drain pan, comprising:

a front wall, a back wall, a first side wall, and a second side wall arranged around an outer perimeter of the drain pan with the front wall opposite the back wall, the first side wall between the front wall and the back wall at a first end of the drain pan, and the second side wall opposite the first side wall and between the front wall and the back wall at a second end of the drain pan that is opposite the first end;

a floor extending from a bottom of each of the front wall, back wall, first side wall, and second side wall;

a drain opening formed in the floor at a point in the floor between the front wall and the back wall and spaced a first distance from the front wall and a second distance from the back wall;

a drain extension extending down from the drain opening and configured to connect to a drain tube;

wherein the floor slopes downward from the bottom of each of the front wall, back wall, first side wall, and second side wall to the drain opening, and wherein the drain pan is configured to be inserted into the wall sleeve and act as a bottom of the wall sleeve;

a raised rim formed around the drain opening which has a height above the floor where the floor meets the drain opening and below the bottom of the front wall, back wall, first side wall and second side wall, and which creates a reservoir around the drain opening; and wherein the wall sleeve drain pan is configured to sit under the chassis drain pan and receive condensate from the chassis drain pan, and wherein a portion of a bottom surface of the floor is configured to be against the bottom of each of the opposing vertical sides when the wall sleeve drain pan is in the wall sleeve.

6. The wall sleeve drain pan of claim 5, further comprising a first canal and a second canal, the first canal formed in the floor of the wall sleeve drain pan and extending from the reservoir to the first side wall of the wall sleeve drain pan; the second canal formed in the floor of the wall sleeve drain pan and extending from the reservoir, opposite the first canal, to the second side wall of the wall sleeve drain pan, and wherein the first and second canals are parallel to the front side and back side.

7. A wall sleeve drain pan for a wall sleeve of a packaged terminal air conditioner (PTAC), the wall sleeve configured to receive a PTAC chassis having a chassis drain pan and the wall sleeve having opposing vertical sides, each of the opposing vertical sides having a bottom that is folded inward, the wall sleeve drain pan comprising:

a front wall, a back wall, a first side wall, and a second side wall arranged around an outer perimeter of the wall sleeve drain pan with the front wall opposite the back wall, the first side wall between the front wall and the back wall at a first end of the wall sleeve drain pan, and the second side wall opposite the first side wall and between the front wall and the back wall at a second end of the wall sleeve drain pan that is opposite the first end;

a floor, the floor extending from a bottom of each of the front wall, back wall, first side wall, and second side wall and having a bottom surface;

a reservoir formed in the floor including a reservoir wall that extends downward from the floor to a reservoir bottom, a drain opening formed through the reservoir bottom, the reservoir bottom extending from a bottom of the reservoir wall to the drain opening, a raised rim formed around the drain opening and having a height above the reservoir bottom and below a top of the reservoir wall, the height of the raised rim being selected to retain a predetermined volume of water in the reservoir between the raised rim and the reservoir wall over the reservoir bottom, wherein the reservoir is spaced away from the front wall by a first distance and spaced away from the back wall by a second distance; and wherein the floor slopes downward from the bottom of each of the front wall, back wall, first side wall, and second side wall to the top of the reservoir wall, and wherein the wall sleeve drain pan is configured to be inserted into the wall sleeve at a bottom of the wall sleeve under the chassis drain pan, and receive condensate from the chassis drain pan, and wherein a portion of the bottom surface of the floor is configured to be against the bottom of each of the opposing vertical sides when the wall sleeve drain pan is in the wall sleeve.

8. The wall sleeve drain pan of claim 1, further comprising a first canal and a second canal, the first canal formed in the floor of the wall sleeve drain pan and extending from the reservoir to the first side wall of the wall sleeve drain pan; the second canal formed in the floor of the wall sleeve drain pan and extending from the reservoir, opposite the first canal, to the second side wall of the wall sleeve drain pan, and wherein the first and second canals are parallel to the front side and back side.

9. The wall sleeve drain pan of claim 1, wherein the reservoir is centrally located between the first end and the second end of the wall sleeve drain pan.

* * * * *